US005964473A

United States Patent [19]

Degonda et al.

[11] Patent Number: 5,964,473

[45] Date of Patent: Oct. 12, 1999

[54] WHEELCHAIR FOR TRANSPORTING OR ASSISTING THE DISPLACEMENT OF AT LEAST ONE USER, PARTICULARLY FOR HANDICAPPED PERSON

[75] Inventors: André Degonda, Baulmes; Thomas Wüthrich, Belp, both of Switzerland

[73] Assignee: Degonda-Rehab S.A., Lausanne, Switzerland

[21] Appl. No.: 08/676,285

[22] PCT Filed: Nov. 17, 1995

[86] PCT No.: PCT/CH95/00270

§ 371 Date: Jul. 17, 1996

§ 102(e) Date: Jul. 17, 1996

[87] PCT Pub. No.: WO96/15752

PCT Pub. Date: May 30, 1996

[30] Foreign Application Priority Data

Nov. 18, 1994 [FR] France ..... 94 13998
Mar. 23, 1995 [CH] Switzerland ..... 857/95

[51] Int. Cl.[6] ..... A61G 5/00

[52] U.S. Cl. ..... 280/250.1; 280/755; 180/907

[58] Field of Search ..... 280/250.1, 755, 280/304.1, DIG. 10; 180/907, 8.2, 9.32, 24.02, 22, 209

[56] References Cited

U.S. PATENT DOCUMENTS

| | | | |
|---|---|---|---|
| 3,848,883 | 11/1974 | Breacain . | |
| 3,905,437 | 9/1975 | Kaiho et al. | 180/15 |
| 3,976,152 | 8/1976 | Bell . | |
| 4,245,847 | 1/1981 | Knott . | |
| 4,310,167 | 1/1982 | McLaurin . | |
| 4,455,031 | 6/1984 | Hosaka | 280/250.1 |
| 4,790,548 | 12/1988 | Decelles et al. . | |
| 4,962,942 | 10/1990 | Barnett et al. | 280/5.28 |
| 5,044,647 | 9/1991 | Patterson | 280/250.1 |
| 5,222,567 | 6/1993 | Broadhead et al. | 180/15 |
| 5,294,141 | 3/1994 | Mentessi et al. | 280/250.1 |
| 5,364,120 | 11/1994 | Shimansky . | |
| 5,494,126 | 2/1996 | Meeker | 180/13 |
| 5,540,297 | 7/1996 | Meier | 180/65.5 |
| 5,564,512 | 10/1996 | Scheulderman | 180/65.5 |
| 5,718,442 | 2/1998 | Alexander et al. | 280/250.1 |

FOREIGN PATENT DOCUMENTS

| | | |
|---|---|---|
| 0 321 676 | 6/1989 | European Pat. Off. . |
| 0 338 689 | 10/1989 | European Pat. Off. . |
| 2 399 822 | 3/1979 | France . |
| 2 165 452 | 7/1973 | Germany . |
| 2 036 570 | 7/1980 | United Kingdom . |
| 2 051 702 | 1/1981 | United Kingdom . |

*Primary Examiner*—Kevin Hurley
*Attorney, Agent, or Firm*—Davis and Bujold

[57] ABSTRACT

The chair according to the invention comprises a chassis (60) with a support for the user, specifically a seat, a cab for a stroller, or handles for pushing the device. The chassis consists of two portions (61, 62) connected by an articulation (63) with a transverse axle. The first chassis portion (61) is equipped with two main wheels (66) whose common axle (67) is near the line of action (p) of the user's weight, and at least one front or rear contact wheel (68). The second chassis portion (62) uses at least one contact wheel (69) to contact the ground at the other end of the chair. The wheels may be arranged in a diamond shape, and the contact wheels (68, 69) turn freely. There is preferably a spring device (72) connecting the two chassis portions to store and release energy when clearing obstacles. In the case of a wheelchair, the main wheels (66) are either manually driven or controlled by separate motors. The distinctive features of such a device are ease of manipulation and ability to clear obstacles.

13 Claims, 19 Drawing Sheets

WHEELCHAIR FOR TRANSPORTING OR ASSISTING THE DISPLACEMENT OF AT LEAST ONE USER, PARTICULARLY FOR HANDICAPPED PERSON

The present invention concerns a wheelchair for transporting or assisting the displacement of at least one user, particularly a handicapped person or a person with little or no mobility, or a child, comprising a chassis with wheels and a means for supporting at least a portion of the user's weight along a vertical line of action when the chair is moving on a surface, said wheels consisting of two main wheels with a common transverse principal axle, and contact wheels comprising at least one front wheel that turns and is in front of the principal axle, and at least one rear wheel that turns and is behind the principal axle.

The applications of the invention extend to a variety of chairs of novel design, or already known in the art, all having in common the ability to provide movable support or a prop for a person who either requires assistance to walk or is unable to walk, such as an individual with handicapped lower limbs, an accident victim, a patient recovering from surgery who is forbidden to walk or advised against walking, a small child requiring a stroller, etc. Thus, the device may take the form of a manually operated or motorized movable wheelchair for either indoor or outdoor use, or any type of chair with castors, a stroller for a handicapped person or a child, a baby carriage, or a walker which supports the user's hands or arms to relieve pressure on the legs, and other such rolling devices or similar light vehicles.

Many types of wheelchairs already exist. In particular, U.K. Publication GB-A-2 051 702 concerns a chair for a handicapped person having a chassis associated with an energy storage device to assist it in negotiating obstacles. This element consists of a simple contact wheel which is a rear wheel mounted on a pivoting arm and connected by a spring to an element of the wheelchair chassis. The chassis consists of one portion and the chair is manually operated, rather than motorized.

The manual chair proposed in U.S. Pat. No. 4,310,167 has a shock absorber connected to an element of the chassis and the arm supporting the rear contact wheel. The chassis consists of two portions which can be separated from each other by a variable distance.

Other embodiments with rear contact wheels are described in U.S. Pat. Nos. 3,848,883, 4,245,847 and 3,976,152.

All these chairs have various elements which only partially meet safety and efficiency requirements, particularly for motorized wheelchairs.

Moreover, all these devices present a problem of when the wheels must clear obstacles. Indoor obstacles might consist of thresholds or sometimes steps. Outdoors, they may be curbs, gutters, stones, or any rough areas in the terrain, if the user wishes to navigate unpaved areas. Except for strollers and baby carriages, for reasons of stability, such wheelchairs often lack suspension systems, as they are usually short and narrow in design to reduce bulk. Thus, the wheels bump into obstacles and maneuvers becomes difficult, rough, or at the very least, uncomfortable. Furthermore, if certain wheels do not touch the ground or if the chair encounters an obstacle while moving along a slope, the chair becomes unstable.

Wheelchair users particularly appreciate wheelchairs of the type described above with two main wheels behind the center of gravity to act as drive wheels, because they improve the chair's turning circle in comparison to outdoor models with forced turning, and also because the front wheels, not being the drive wheels, are smaller, allowing the user to more closely approach the object he or she wishes to reach. On the other hand, small front wheels, which might take the form of turning castors, make it difficult to navigate obstacles such as curbstones. Wheels such as this must be raised up for the wheelchair to climb a curb, causing the chair to tip backwards. Since this is dangerous, most manufacturers propose two additional small contact wheels located behind the main wheels, higher than the ground, which contact the ground if the chair's position exceeds a certain angle, thereby preventing a backward fall. This angle must be great enough so that the front wheel or wheels can reach a sidewalk of normal height. A sudden acceleration of the manual or motorized drive may cause tipping just before the wheel or wheels contact the curb. This is a delicate maneuver, as the chair cannot tip so suddenly that it causes a sudden shock in the rear, and it must be accomplished in time so the wheelchair is not blocked if the wheels are raised too late and contact the curb, or if they redescend too soon after acceleration. In addition, the rest of the operation may be rough, as the main wheels are also subjected to shocks when they bump the sidewalk and require a strong drive connection to climb the curb, using the energy previously acquired.

The goal of the present invention is to provide an improved wheelchair overcoming the disadvantages described above, which is easy to manipulate and can surmount obstacles such as thresholds, curbs, or rough terrain, and which is effortless, reliable and comfortable to use because of its relatively simple construction.

According to a first embodiment, the invention comprises a wheelchair of the type described in the preamble, characterized in that the main axle is essentially vertical and located near said vertical line of action when the chair is on horizontal ground, in that the chassis comprises at least two portions with wheels, the portions being interconnected by at least one main articulation whose axle is parallel to the main axle, in that said chassis portions comprise a first portion, supported by the ground and equipped with the main wheels and the front or rear contact wheel or wheels, and a second portion designed to be supported by both the first portion and the ground, and provided with the other contact wheel or wheels, and in that it comprises an energy storage device connected to the two chassis portions for storing mechanical energy when the contact wheel or wheels on the second chassis portion are raised above the supporting surface defined by the wheels on the first chassis portion.

Since the line of action of the load is disposed near the main axle, in the center, the main wheels always support the majority of the load and the dead weight. And since the first chassis portion comprises the main wheels and at least one contact wheel, that is, the front or rear contact wheel or wheels, depending upon the design, it is the vehicle element which remains stable on the supporting surface, while the resultant of the forces applied to it falls into the supporting polygon defined by the wheels. Because the main articulation is suitably positioned, it is possible to act upon the position of the resultant for optimal distribution of the weight on the wheels of the first chassis portion. For example, if the second chassis portion is supporting the user's weight and/or considerable dead weight, such as electrical batteries, the line of action of this load can be located on either side of the main axle without affecting the stability of the first potion, as will be seen in subsequent examples. Furthermore, since the chassis is articulated, the wheels do not require suspension, but can remain in permanent contact with the ground, even on rough terrain. Not only does stability improve, but a chair mounted on an articulated chassis is more comfortable for the user.

According to a particularly advantageous embodiment of the invention, the energy storage means may comprise at least one spring exerting a variable force on the second chassis portion depending upon the position of said second portion in relation to the first portion.

Thus, for example, if the second portion of the chassis is equipped with the rear contact wheel or wheels, a device such as a wheelchair or a stroller can rest normally on its main wheels and its front wheel or wheels, with the common center of gravity being slightly forward of the main axle. This small distance allows the chair to tip backwards easily and establish contact with the flexibly mounted rear wheel or wheels, providing a double dynamic effect. First, the extent to which the front wheel (or each front wheel) lifts from the ground is regulated, since it corresponds to the vertical movement of the rear contact wheel (or each rear contact wheel) as a function of the force of the tipping motion. Secondly, the energy accumulated from this motion, for example in the springs, is used to raise the wheelchair at the moment the main wheels need to clear the obstacle. In descending from a sidewalk, the flexible attachment of the rear contact wheel or wheels relieves stress on the main wheels.

In a particularly advantageous embodiment of the invention, the wheelchair has only one front contact wheel and only one rear contact wheel, disposed in a generally longitudinal median plane, and the main wheels are symmetrical with each other in relation to the plane. Thus, the wheelchair might have four wheels in an approximate diamond-shaped arrangement, with the main wheels being to the right and to the left of the common center of gravity and supporting most of the weight, while the front wheel and the rear wheel function like turning castors, and define, along with the main wheels, a front triangle and a rear triangle contacting the ground. Since the rear contact wheel is of adjustable height because of the articulated chassis, the two triangles are not necessarily in thy same plane, and the user may choose to lean upon one or the other. Normally, the user would lean on the front triangle, but might prefer to tip back and raise the front wheel in order to clear an obstacle, as described above. In addition, the diamond-shaped arrangement reduces bulk, allows lightweight construction, and provides excellent steering.

Other embodiments cited in the examples below facilitate the chair's ability to tip as described above. First, the user can temporarily move the seat toward the front or back to displace the center of gravity in relation to the wheels. Additionally, the front of the seat may be provided with lifting means, such as supplemental wheels, located above and in front of the contact wheels, which are the first to contact the obstacle.

Another feature of the invention concerns a seat wherein the articulated connection between the two chassis portions is replaced by a sliding connection which is approximately vertical.

Other characteristics and advantages of the invention will be more apparent from the following description of various embodiments and applications, with reference to the attached drawings, wherein.

Figure 4:
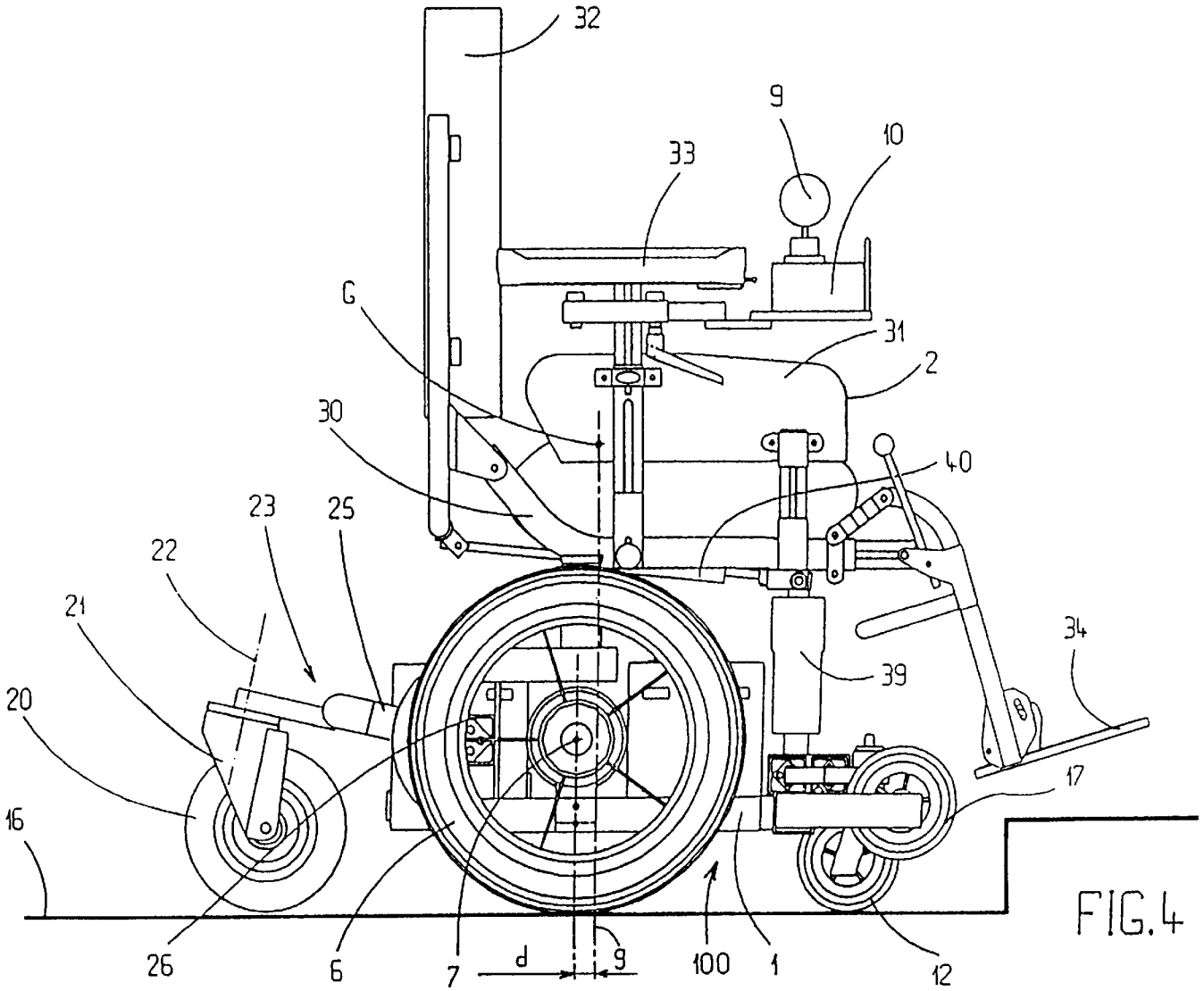
FIG. 4 is a lateral elevation view of the wheelchair of FIG. 1.
Figure 5:
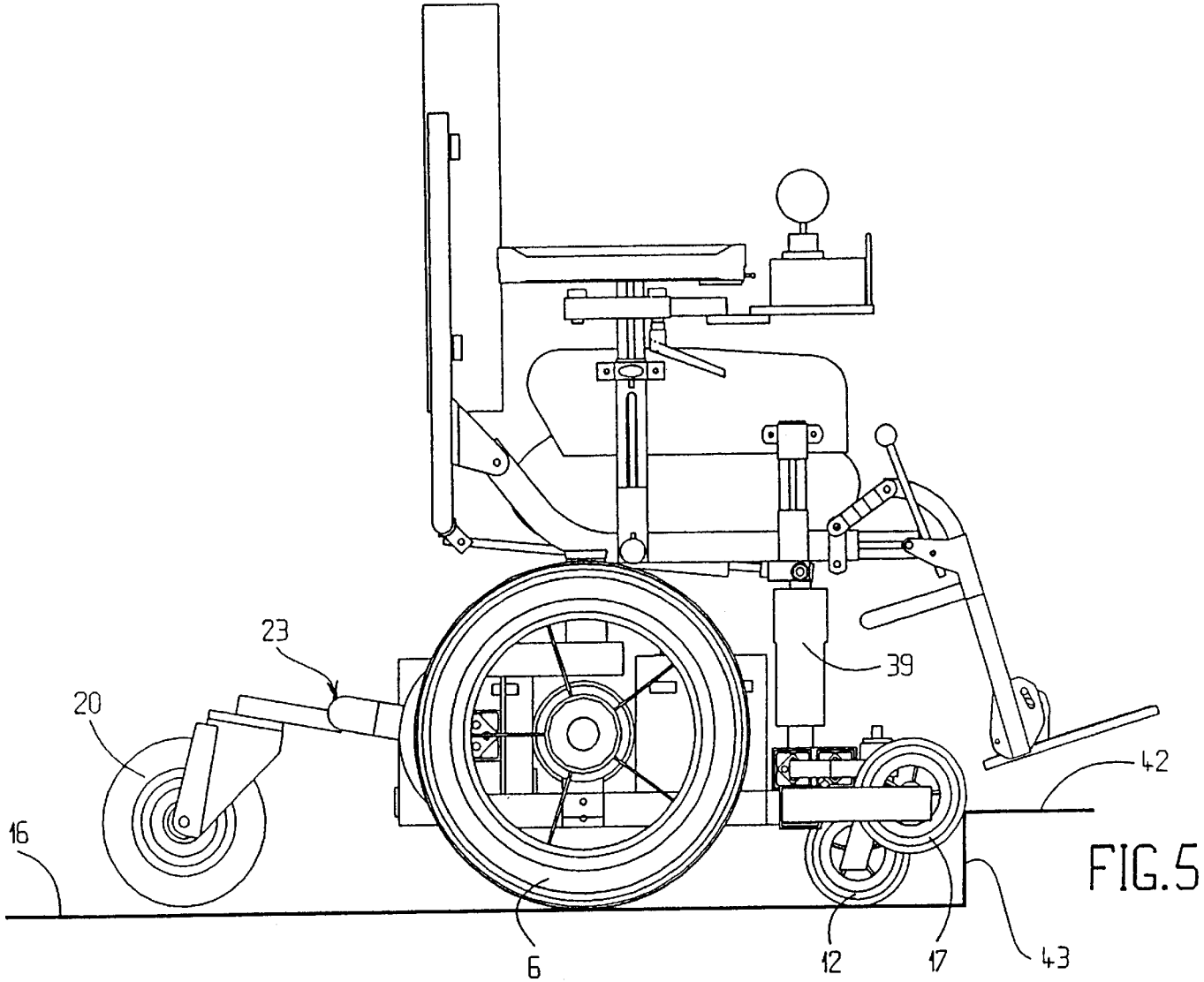
Figure 6:
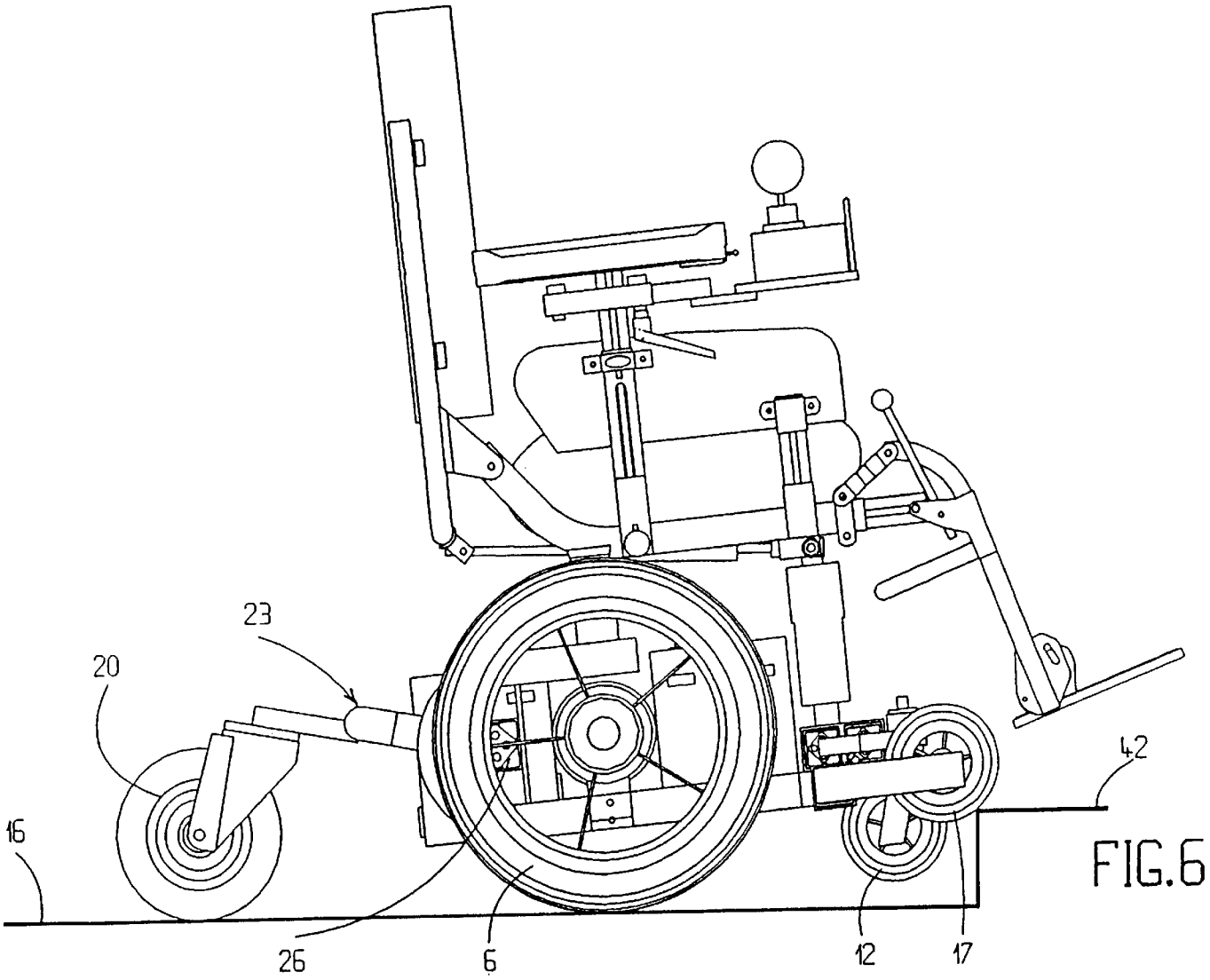
Figure 9:
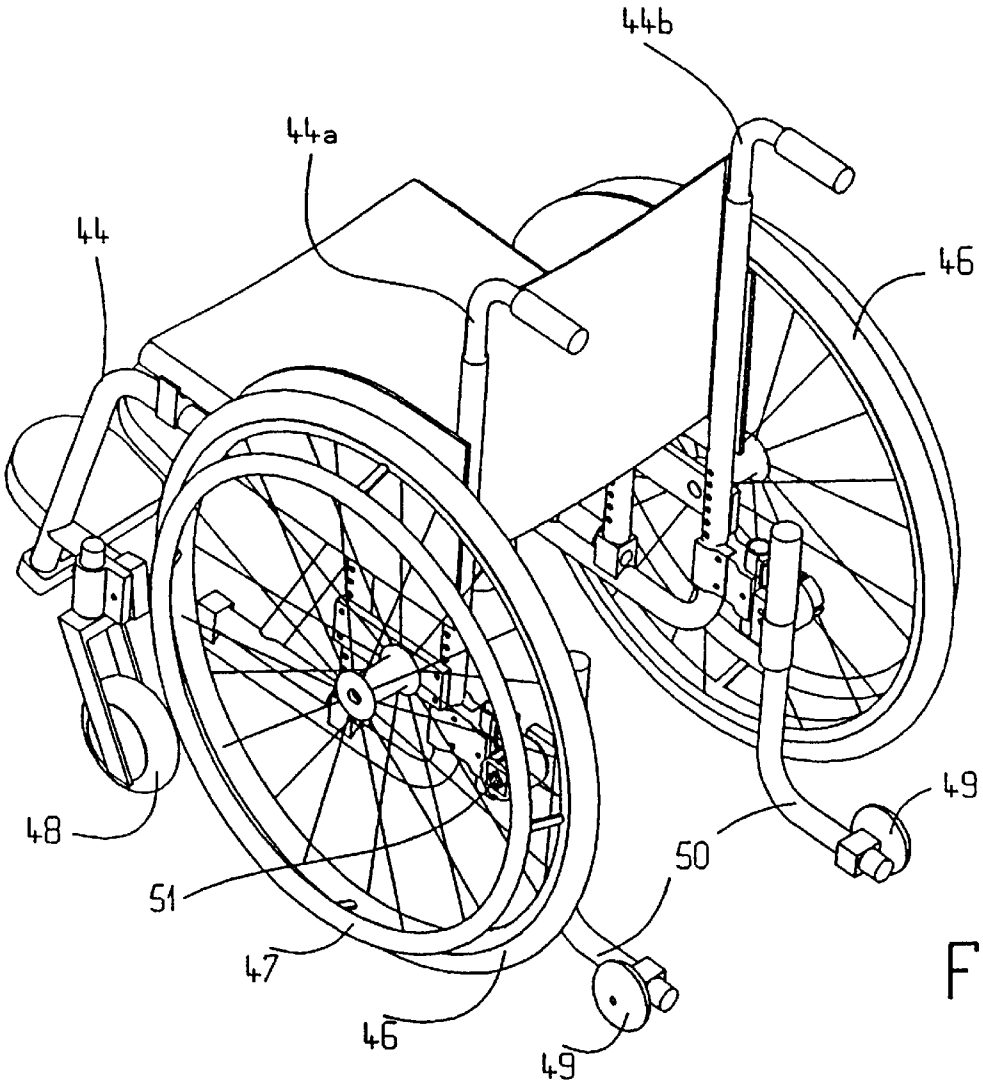
Figure 10:
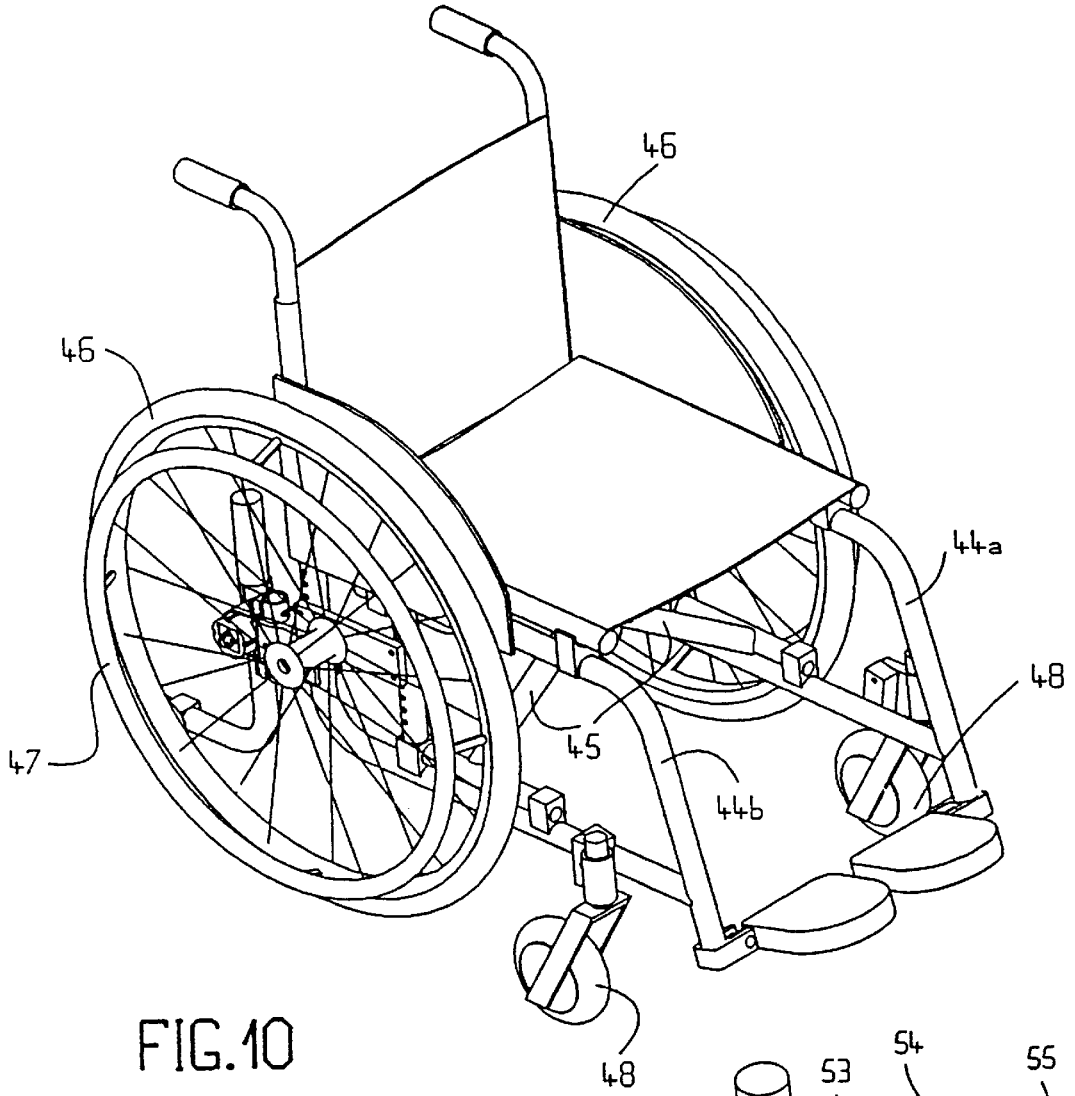
Figure 11:
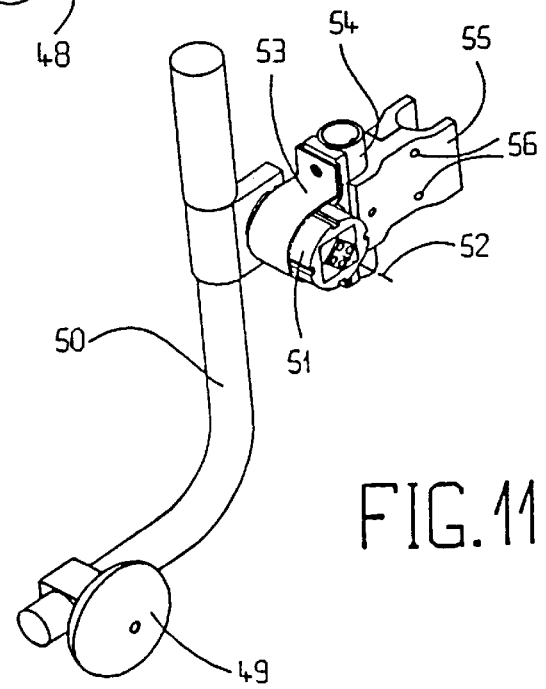
Figure 12:
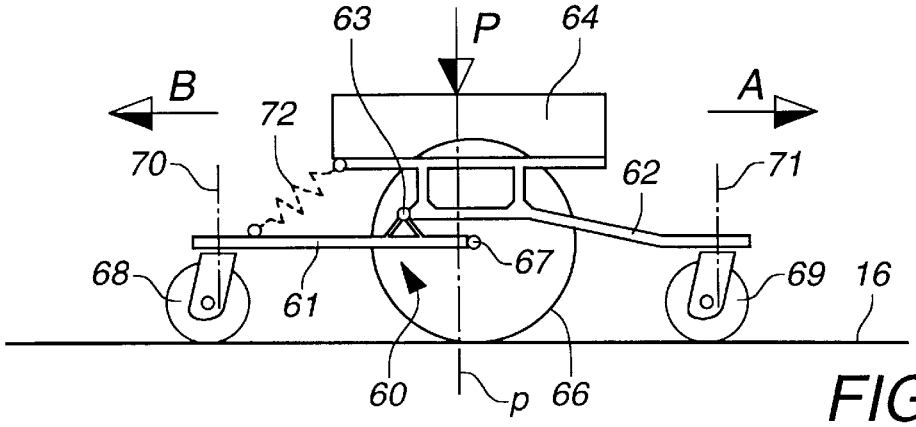
Figure 14:
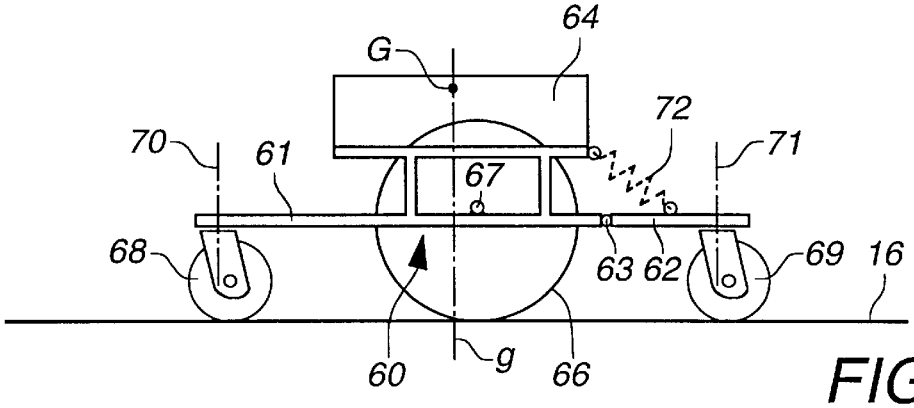
Figure 16:
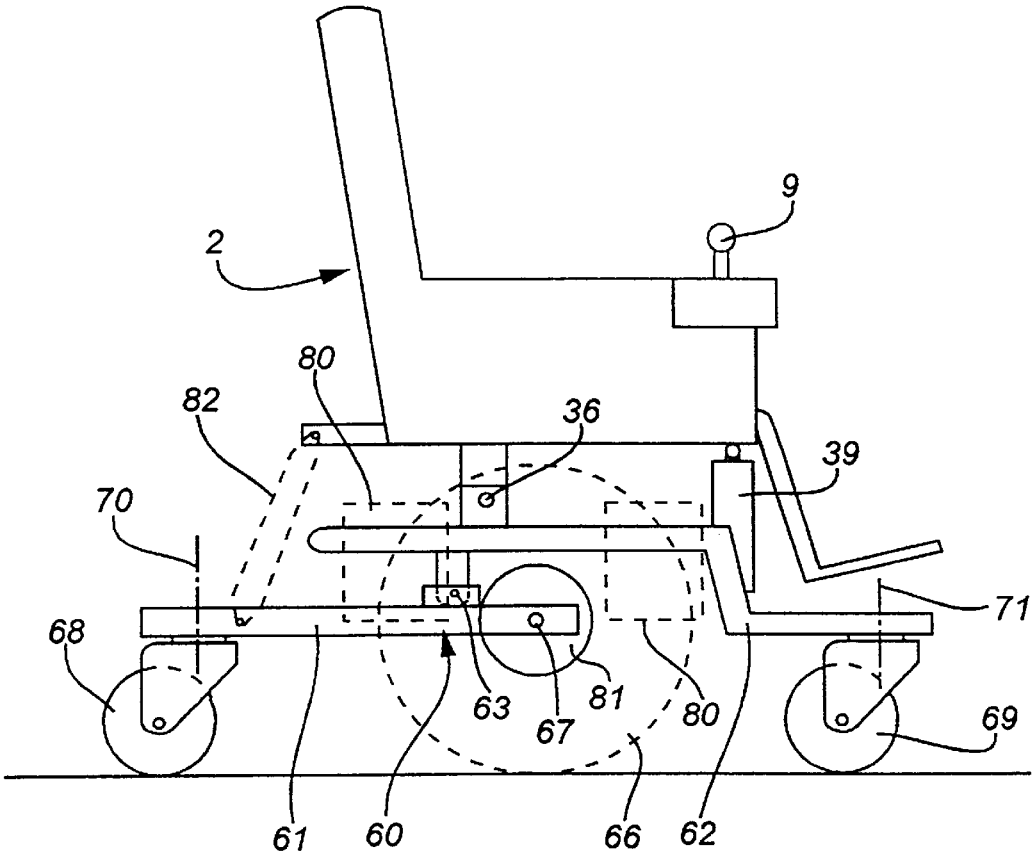
Figure 17:
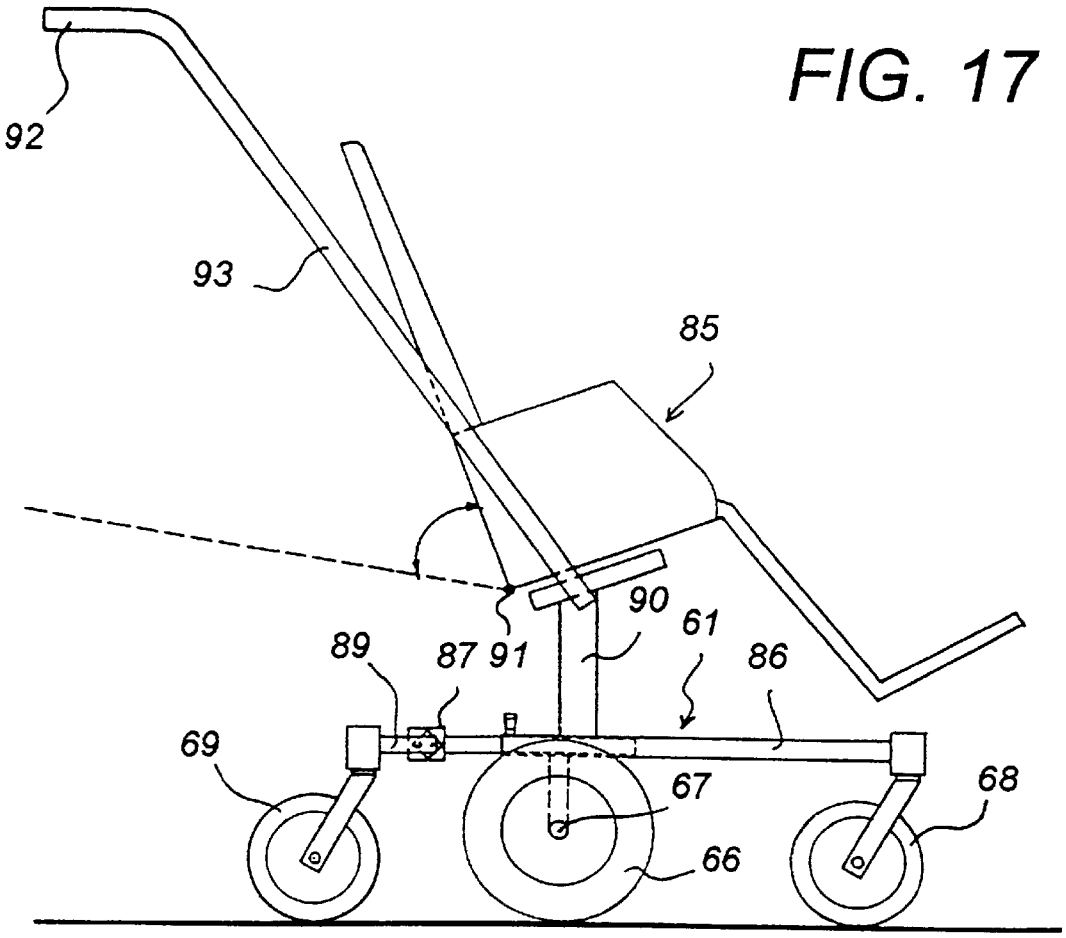
Figure 18:
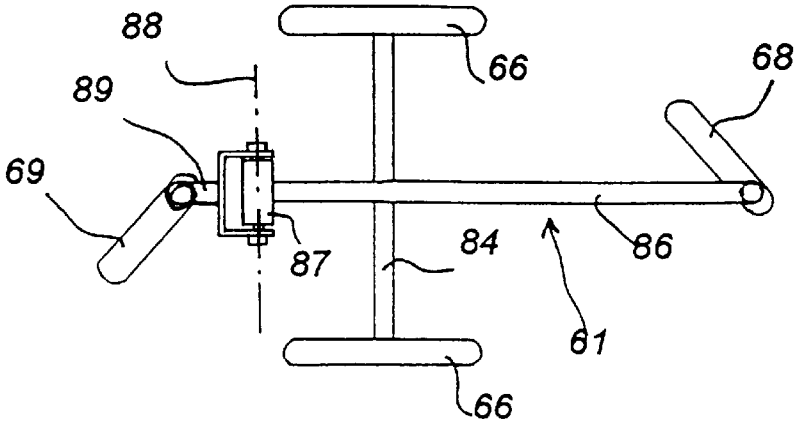
Figure 19:
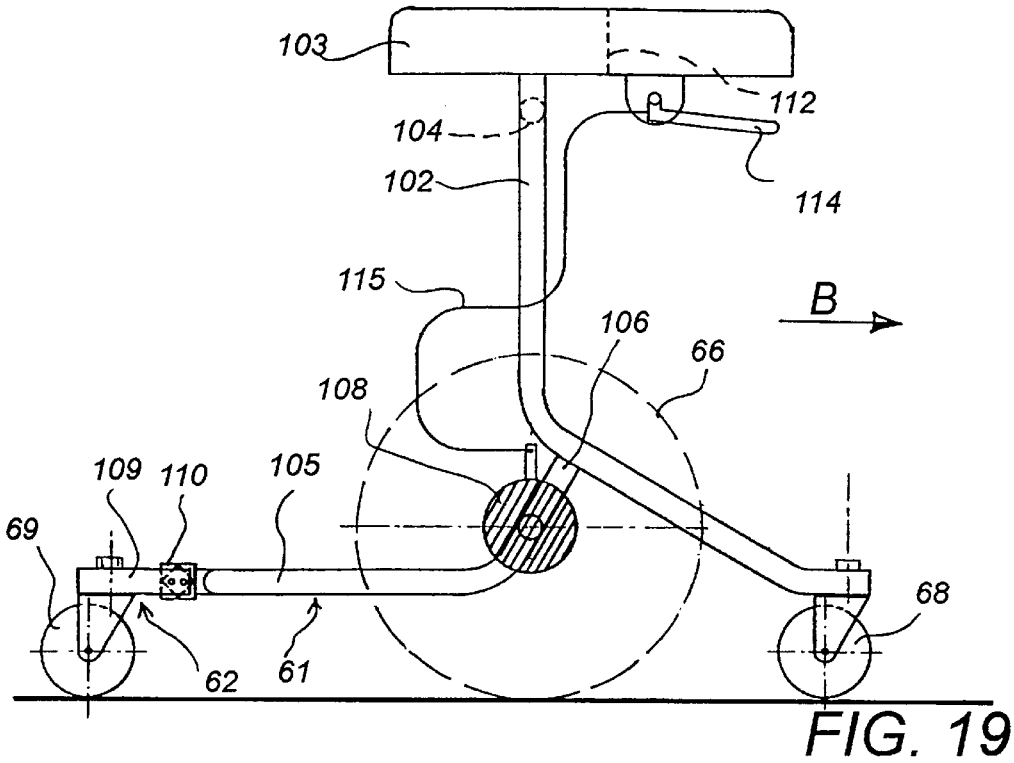
Figure 20:
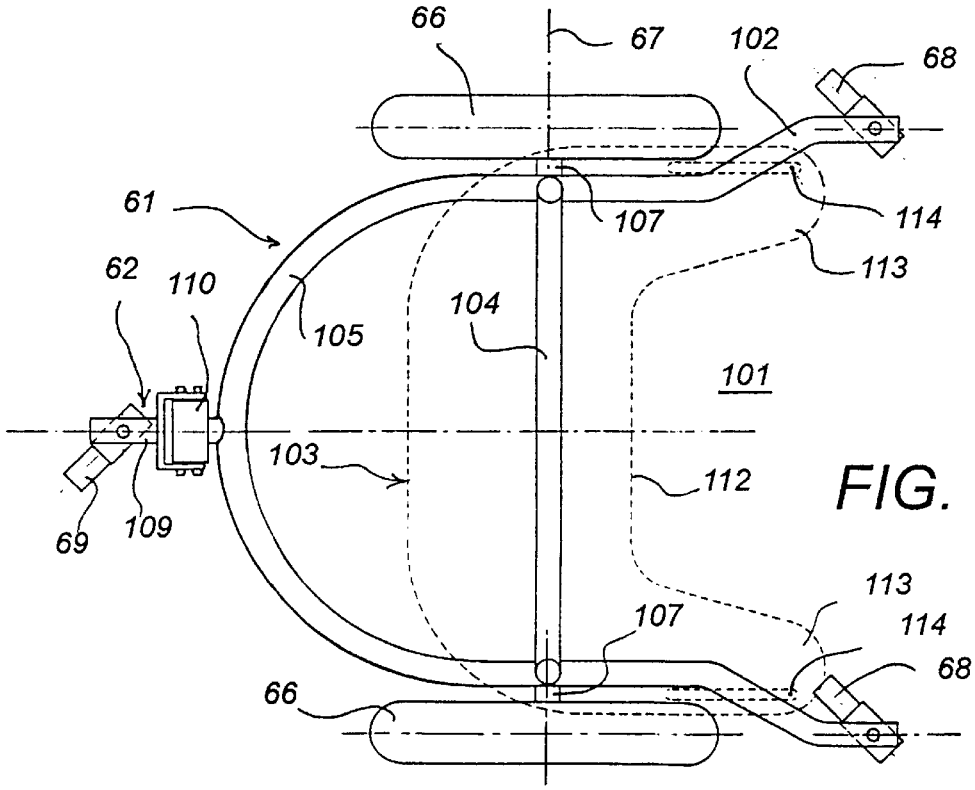
Figure 21:
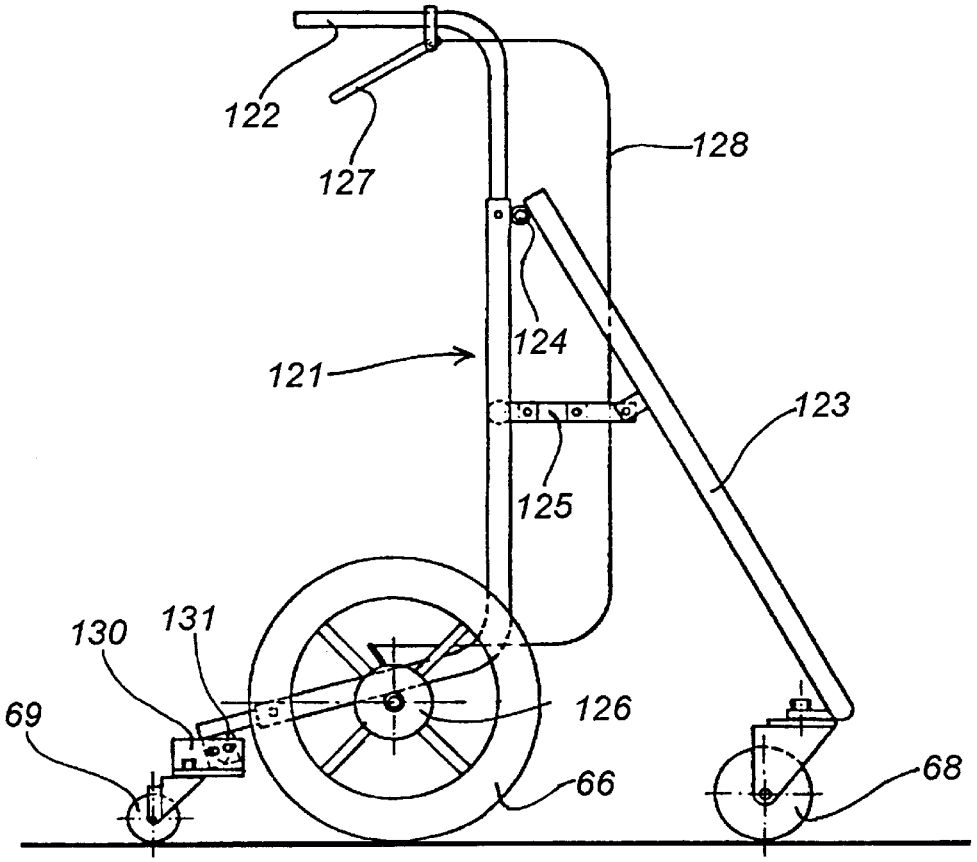
Figure 22:
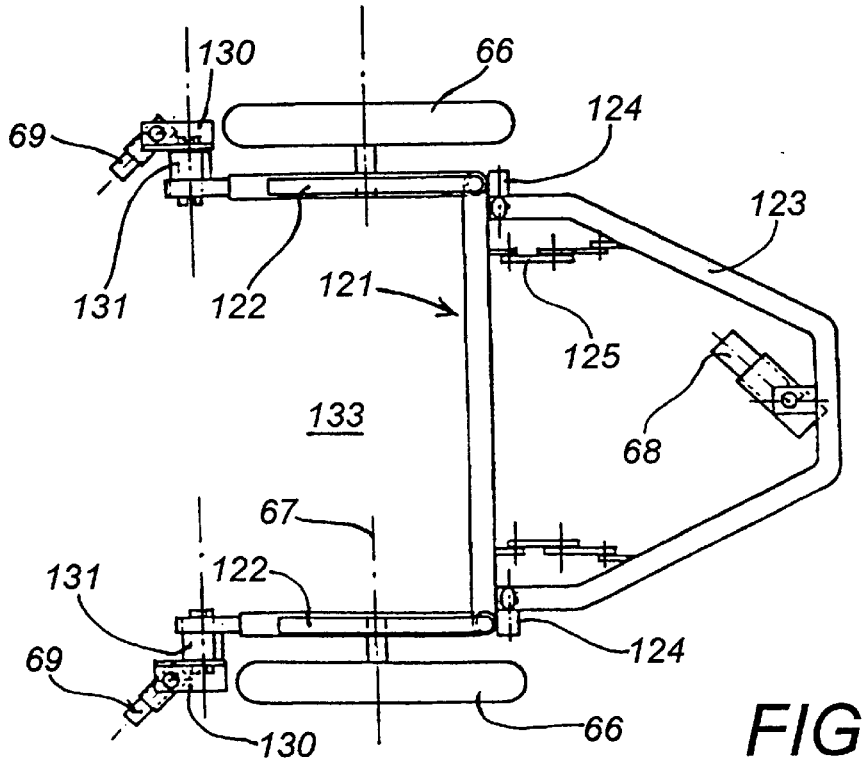
Figure 23:
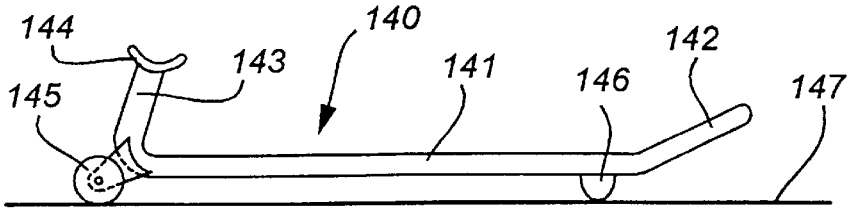
Figure 24:
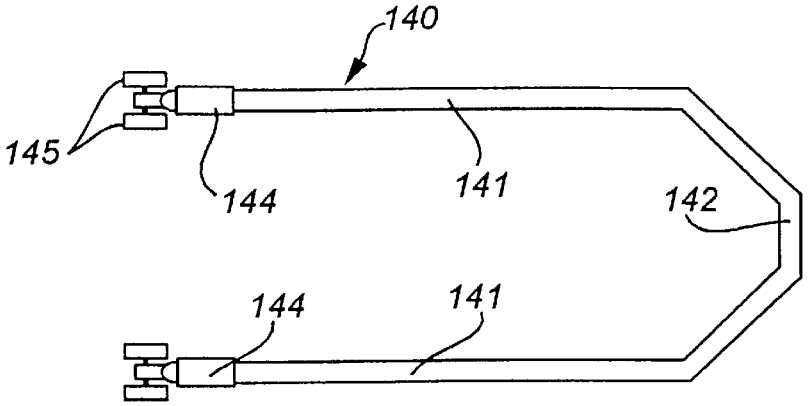
Figure 27:
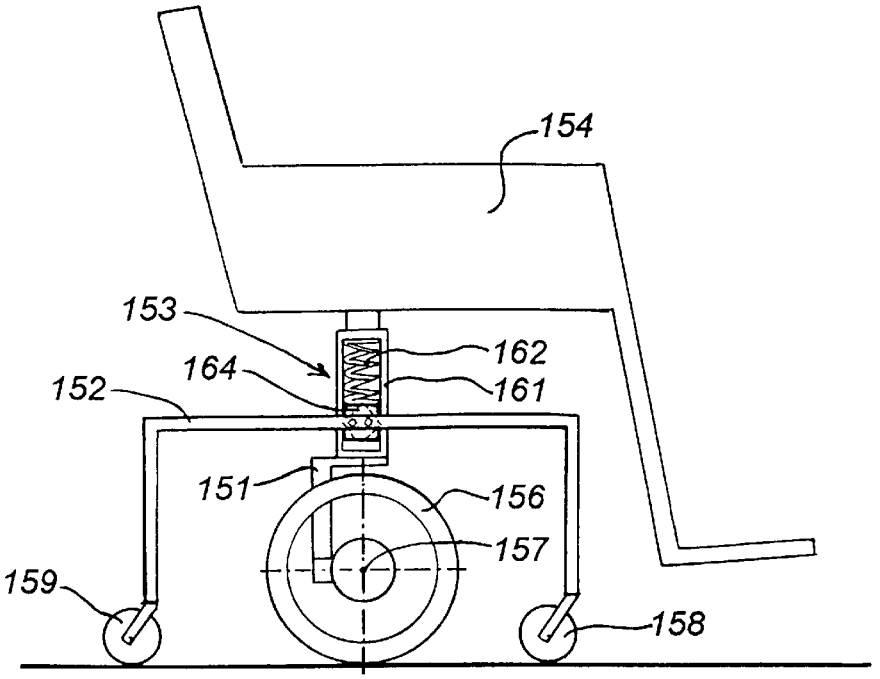
Figure 25:
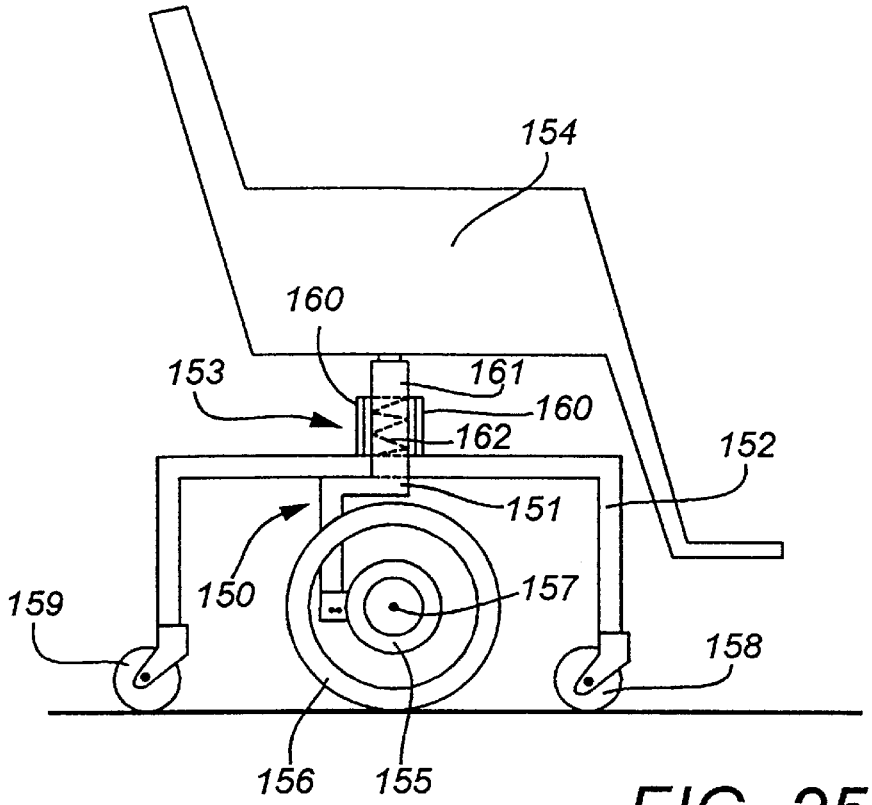
Figure 26:
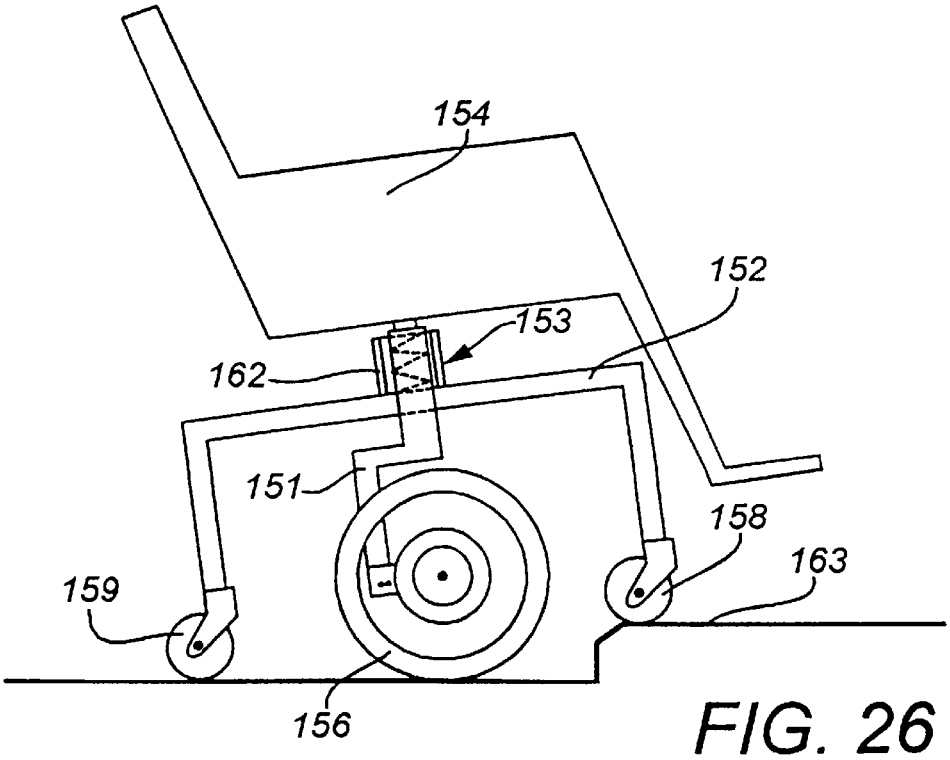

FIGS. 5 though 8 are views analogous to FIG. 4, showing various phases in the movement of the wheelchair as it accesses a sidewalk;

FIGS. 9 and 10 are two perspective views of another embodiment of a manually operated wheelchair according to the invention;

FIG. 11 is an enlargement view of a movable rear lever of the wheelchair of FIGS. 9 and 10;

FIGS. 12 through 15 are lateral schematic drawings showing various possible combinations of the chassis portions of the wheelchair according to the invention, as well as various methods of attaching the support means to the chassis;

FIG. 16 is a lateral schematic drawing of a wheelchair with a chassis corresponding to the schematic in FIG. 12;

FIG. 17 is a lateral view of a stroller with a chassis corresponding to the schematic in FIG. 14;

FIG. 18 is a partial plan view showing the lower portion of the stroller of FIG. 17;

FIG. 19 is a lateral view of a wheelchair for a person capable of pushing one foot along the ground to propel the chair, with a chassis corresponding to the schematic of FIG. 14;

FIG. 20 is a plan view of the wheelchair of FIG. 19, with the seat itself shown as transparent;

FIGS. 21 and 22 are a lateral elevation and a plan view, respectively, of a walker according to the invention;

FIGS. 23 and 24 are a lateral elevation and a plan view, respectively, of an accessory which may be used with the wheelchair according to the invention;

FIG. 25 is a schematic drawing of another type of wheelchair according to the invention;

FIG. 26 shows an obstacle is negotiated by the wheelchair of FIG. 25;

FIG. 27 is a variation the wheelchair of FIG. 25; and

Figure 28:
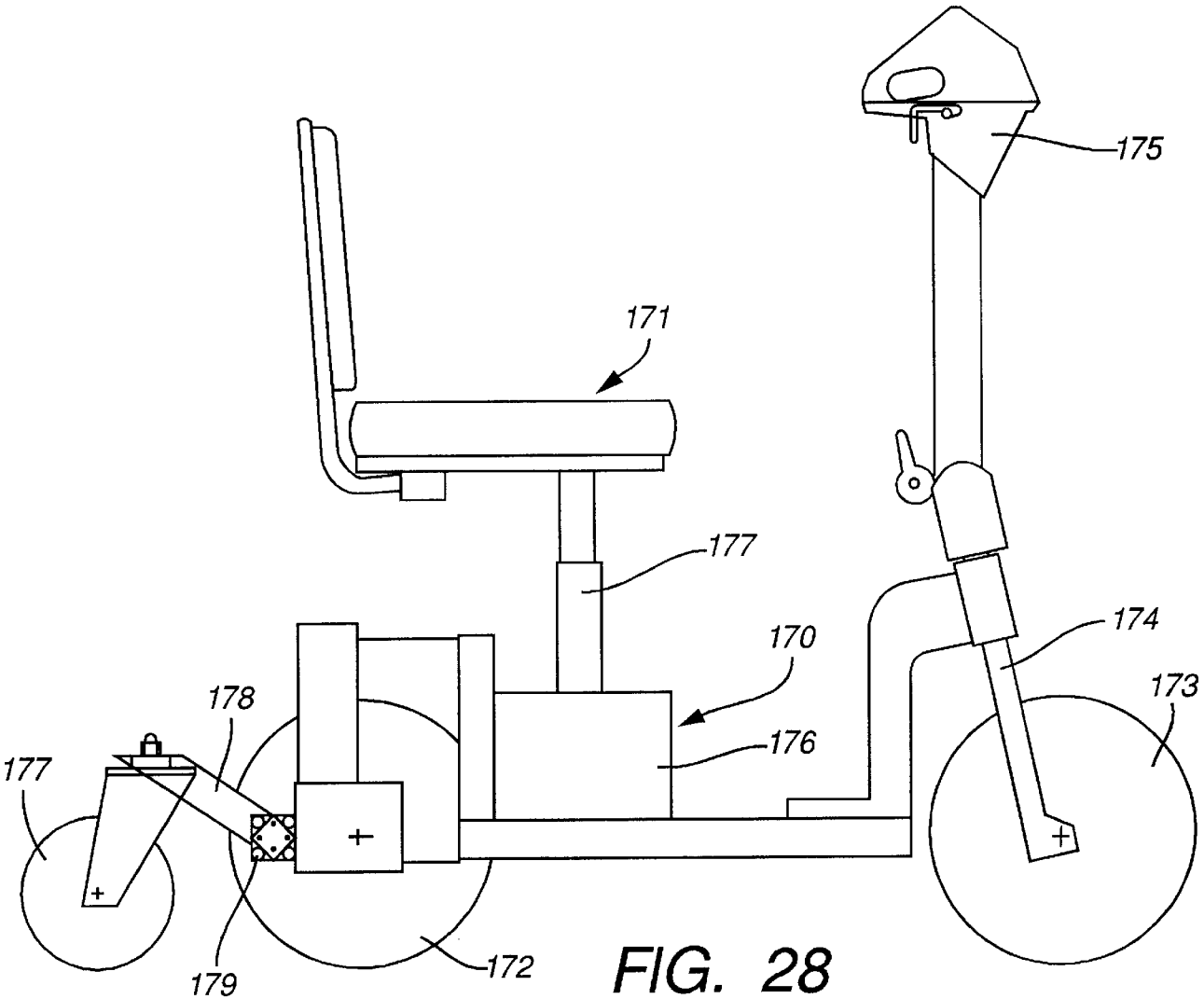
Figure 29:
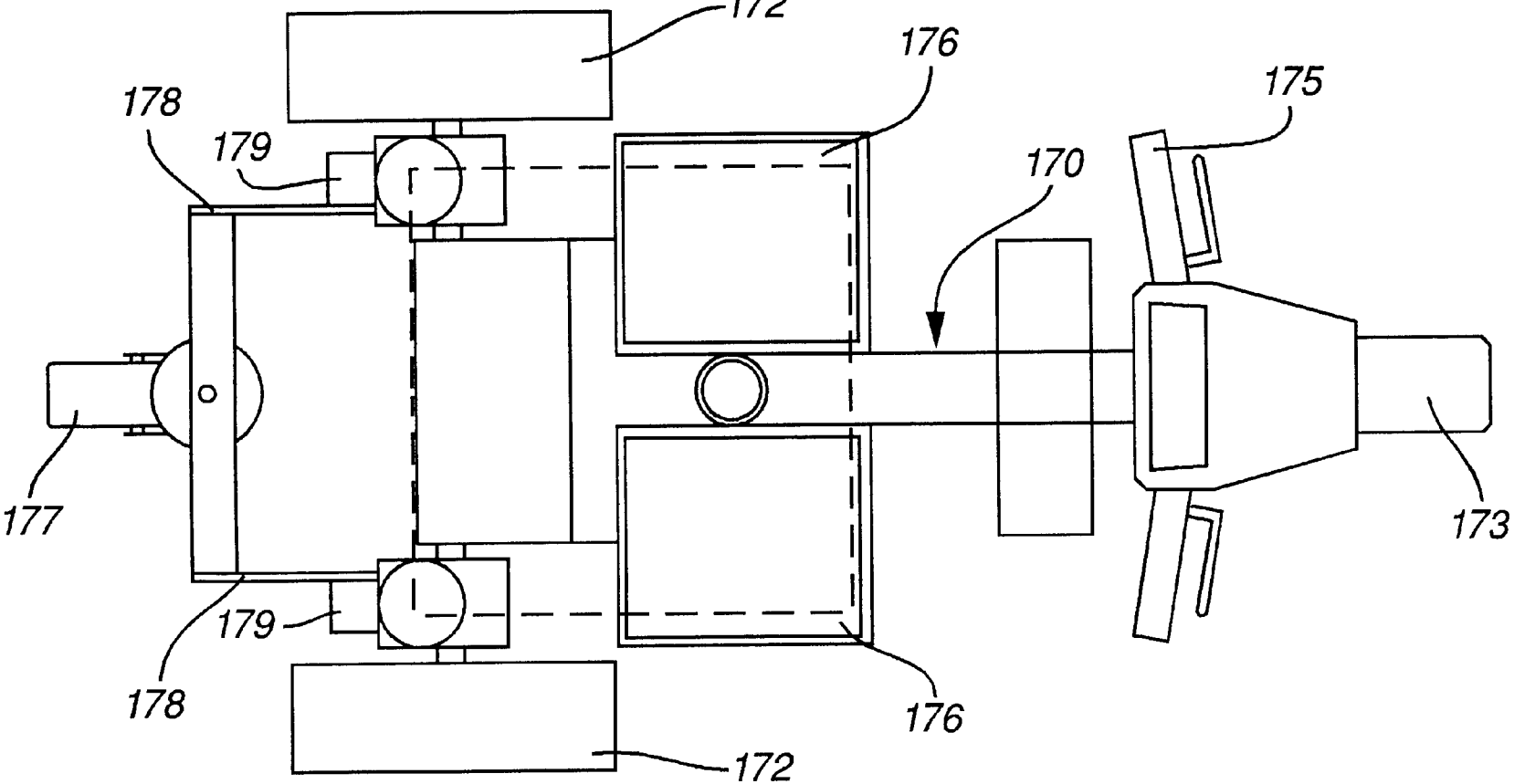

FIGS. 28 and 29 represent a motorized tricycle for a handicapped person, shown in elevation and from above.

In the form shown in FIGS. 1 through 4, the wheelchair for handicap use is electrically driven. It is composed of two main elements: the drive mechanism shown in FIG. 2, with an articulated metal chassis 100; and a seat 2 for the user, which is attached to chassis 100 and is adjustable. Chassis 100 comprises a first portion, the main rigid chassis 1, and a second portion, a rear arm 23 articulated to main chassis 1 along a horizontal transverse axle 27. Main chassis 1 essentially consists of two angled lateral tubes 3 which are U-shaped and connected by a rigid platform 4 which supports two electrical batteries 5. Two main drive wheels 6, which are relatively large in diameter, are attached to each side of chassis 1, perhaps by suspension devices (not shown), and are mutually aligned on a main geometric axle 7 which is near a vertical line passing through the center of gravity G common to the wheelchair and the user, so that main wheels 6 support the majority of the weight of both the wheelchair and its occupant. Each main wheel 6 is driven by its own electric motor 8 supplied with continuous current, while the user controls direction and rotation speed using a known means, such as a multidirectional lever 9 called a joystick, acting upon an electronic control unit 10 to determine both displacement speed and turning radius. Under normal conditions, the wheelchair's longitudinal stability is ensured by a front contact wheel 12 attached to an angled housing 13 which rotates freely around a vertical axle in a central support shaft 14, which is itself flexibly attached to main chassis 1 by a "ROSTA" type spring bearing 15. This device, which is known in the art, comprises two square metal tubes, one inside the other, with the inside tube turned 45° in relation to the outer tube and held inside it by flexible rubber blocks which allow it to pivot elastically around its axle to a limited extent. The two main wheels 6 and front wheel 12 define the normal triangle of contact between the wheelchair and the ground 16.

In the example described here, two other wheels, called the lift wheels 17, are located at the front of the main chassis 1 on either side of front wheel 12, to facilitate clearing obstacles, as will be shown below. Each lift wheel 17 rotates freely around a horizontal axle at the extremity of support arm 18, which is flexibly attached to the chassis by means of a spring bearing 19, which may also be a "ROSTA" type bearing. Thus, each arm 18 also pivots around a horizontal axle, which allows its wheel 17 to lift up when it abuts an obstacle. The two lift wheels 17 are slightly forward of wheel 12 and always higher than wheel 12, so they do not normally touch the ground. Each arm 18 could also have a rotating star with three wheels in a plane, rather than one wheel 17, as in the familiar device for transporting loads on stairs. Another variation provides a lever that pivots downward and has a shoe contacting the ground, replacing each arm 18.

Figure 1:
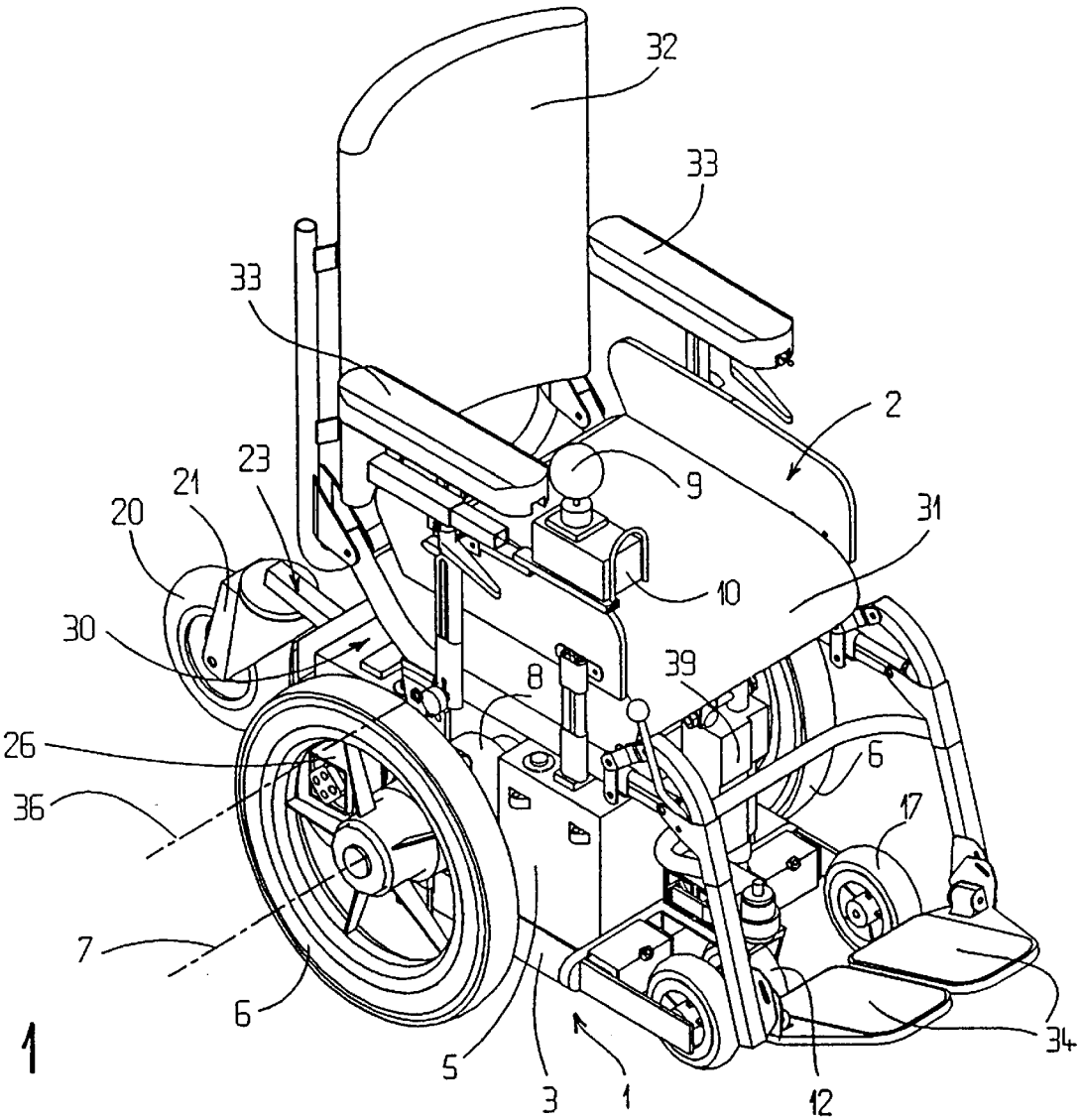
FIG. 1 is a perspective view of an embodiment of an electrically driven wheelchair according to the invention.
Figure 2:
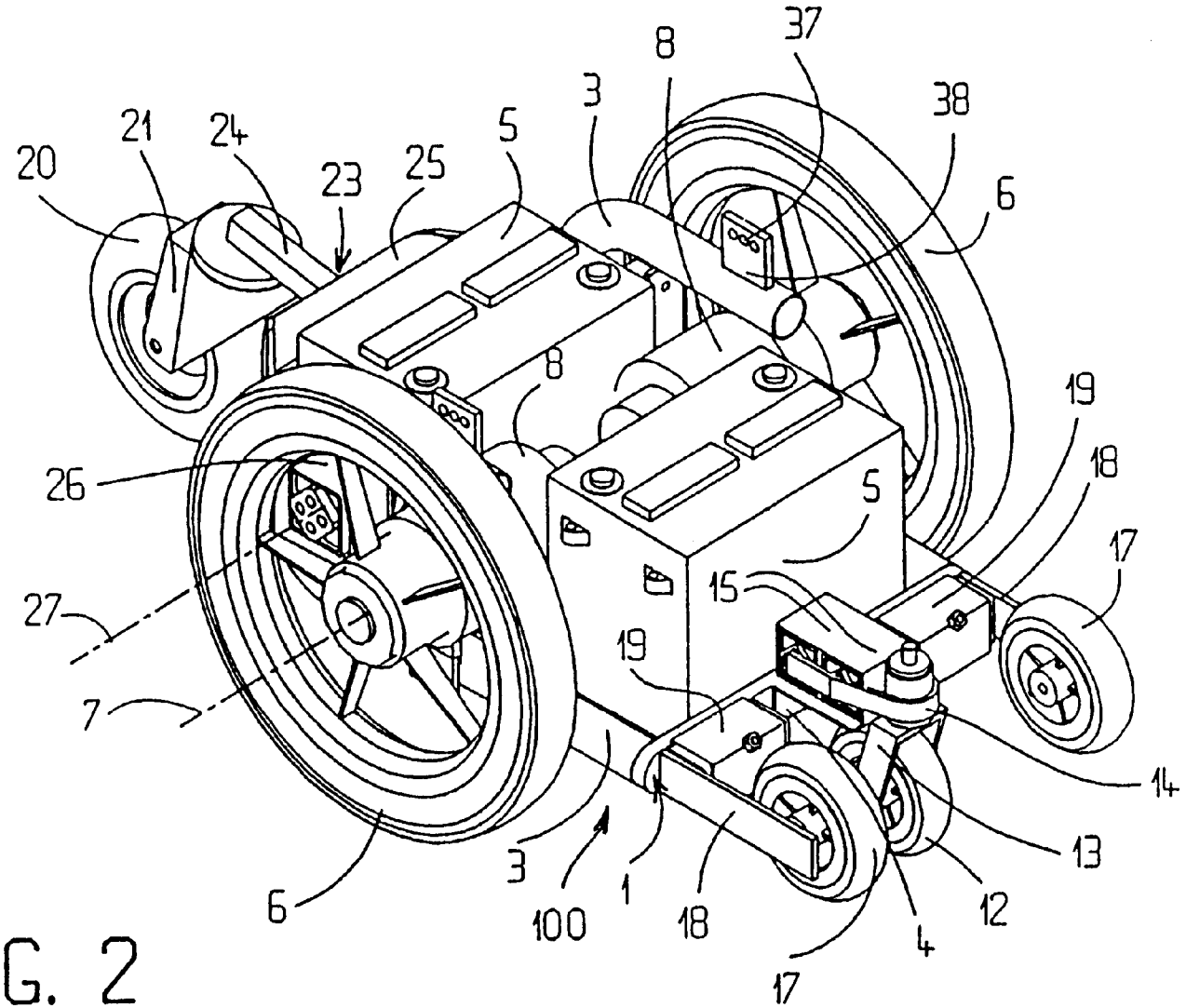
FIG. 2 is a detailed perspective view of the lower portion of the wheelchair of FIG. 1, with the seat removed.
Figure 3:
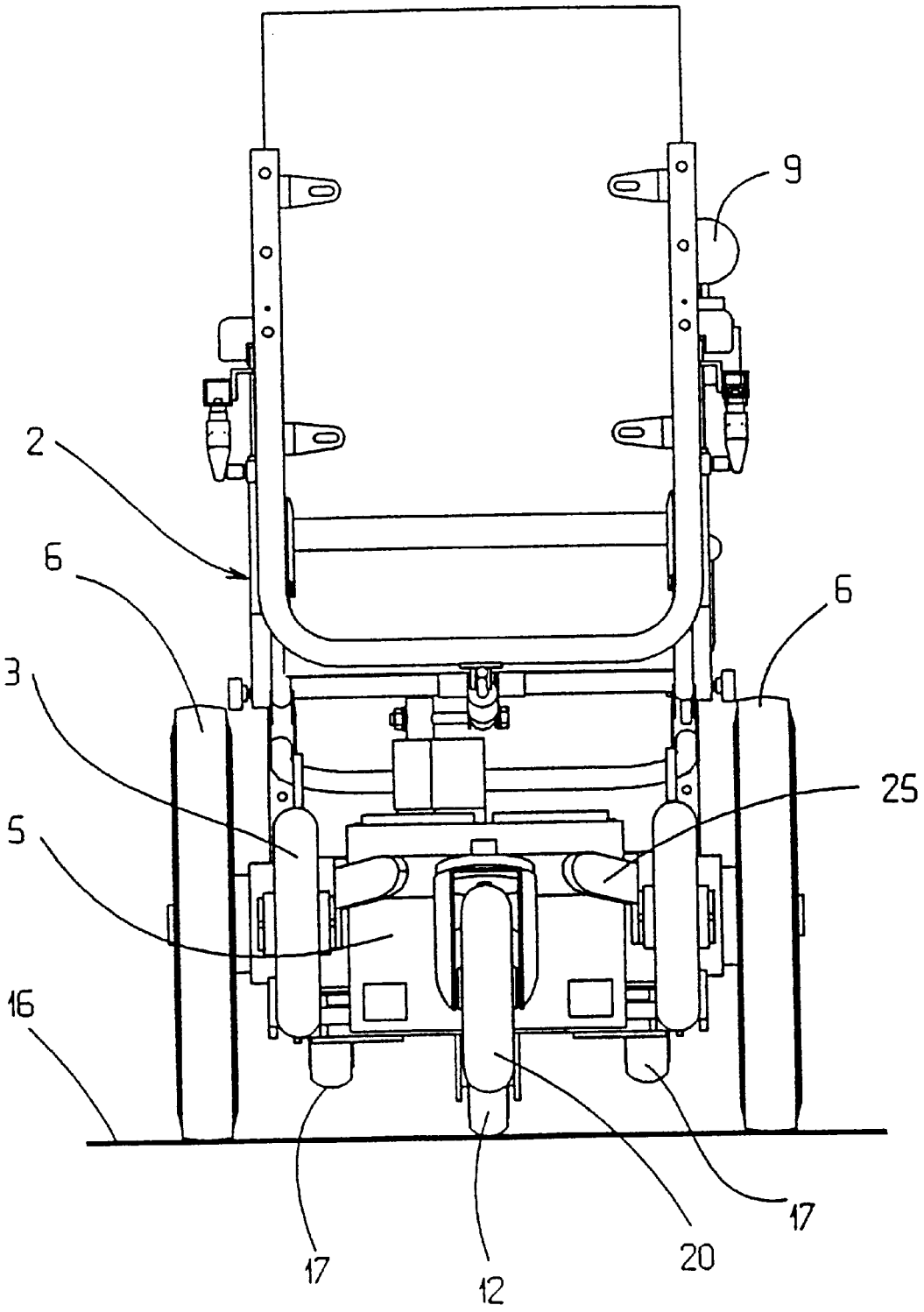
FIG. 3 is an elevation view of the rear of the wheelchair of FIG. 1.

In the rear, there is a central contact wheel 20 mounted inside an angled housing 21 which pivots around an axle 22 generally inclined toward the front, on inclinable rear arm 23. In the present case, arm 23 is composed of a central arm 24 attached to a U-shaped stirrup 25, the ends of which are flexibly and pivotably attached to two articulating spring bearings 26, which are also "ROSTA" bearings, defining a horizontal axle 27 for the tipping movement of arm 23 (FIG. 2). Thus, axle 27 constitutes a transverse articulating axle for wheelchair chassis 100. As shown in FIG. 4, rear arm 23 is normally positioned so that rear support wheel 20 is slightly above the ground 16 when the wheelchair rests on front wheel 12. The wheel will touch the ground if the wheelchair tends to tip backwards and, in this event, spring bearings 26 will exert a variable contact force on wheel 20 as a function of the amplitude of the tipping movement of arm 23 around axle 27. As shown in FIG. 4, when wheel 20 does not touch the ground, it tends to pivot toward the front due to the inclination of axle 22, thereby conserving space. When it touches the ground, it points in the direction that motors 8 impose on the wheelchair. However, spring bearings 26 can also be adjusted to maintain wheel 20 in permanent contact with the ground if the ground is flat enough.

The design of wheelchair seat 2 is generally known in the art. The seat comprises a support frame 30 having a cushion 31, a backrest 32, arm rests 33, and a pair of foot supports 34 which are adjustable to adapt to the user's size and physical condition. The adjustment means are known in the art and will not be described in detail here. However, it should be noted that seat 2 is attached to main chassis 1 in such a way that it can tip on a horizontal axle 36 shown in FIG. 1. This axle is defined by a pair of opposing rods (not shown), each engaged in an opening 37 in a support plate 38 attached to each tube 3 on the chassis, above axle 7 of the main wheels 6. Each plate 38 has several openings 37 for initial longitudinal adjustment when seat 2 is positioned. In order for seat 2 to tip or rock, its position is controlled by a device consisting of an electric shaft 39, which is approximately vertical and attached to the front of main chassis 1; it acts upon an approximately horizontal central lever 40 affixed to seat frame 30. Shaft 39 can be controlled by the user while the chair is in use, using a toggle button (not shown) on control box 10. It is used primarily to displace the user's center of gravity toward the rear or toward the front, and thereby also displace the common center of gravity G (FIG. 4) of both the wheelchair and the user. Normally, when the wheelchair rests on a horizontal surface 16, a vertical line g through the common center of gravity G passes in front of main axle 7 of wheels 6 at a distance d which is as small as possible, but adequate to cause the wheelchair to generally establish contact with front wheel 12. The value of d is generally less than 5 cm and preferably of the order of 2 cm. Thus, by activating shaft 39, the user can displace the position of G during operation, specifically, move it back so vertical line g passes behind main axle 7, causing the wheelchair unit to tip backward and to contact rear wheel 20, lifting front wheel 12 so the chair can clear an obstacle. Similarly, the user can relocate the center of gravity G to the front when the wheelchair has cleared the obstacle or afterward, so the wheelchair once again contacts front wheel 12.

FIGS. 5 through 8 show how easily the wheelchair of the invention can access a sidewalk 42 of normal height in relation to the street 16. In this situation, suppose the user does not activate shaft 39, that is, the wheel approaches the curb 43 of the sidewalk in the position shown in FIG. 5, where front wheel 12 remains on the street, while rear wheel 20 has not yet touched the street. When the the sidewalk curb 43 abuts lift wheels 17, it pushes them up, which has a dual effect. First, wheels 17 contact the top of the sidewalk 42, and secondly, the force they exert on the spring bearings tends to cause main wheelchair chassis 1 to tip backwards, thus lifting front wheel 12 and causing rear wheel 20 to contact the ground 16, and support arm 23 to pivot into the position shown in FIG. 6. At this instant, front wheel 12 contacts the curb 43 of the sidewalk, increasing the angle of the wheelchair and accumulating energy in the spring bearings 26 of arm 23, until front wheel 12 rolls onto sidewalk 42. Note that, advantageously, the user can contribute to the action of tipping backwards by accelerating briefly when reaching the sidewalk. If the user accelerates soon enough, the wheelchair will tip backwards before its first contact with the sidewalk, with front wheel 12 raised as in the position of FIG. 6, instead of the position shown in FIG. 5. Acceleration also causes energy to accumulate in spring bearings 26, which will be released in the next stage of operation.

Figure 7:
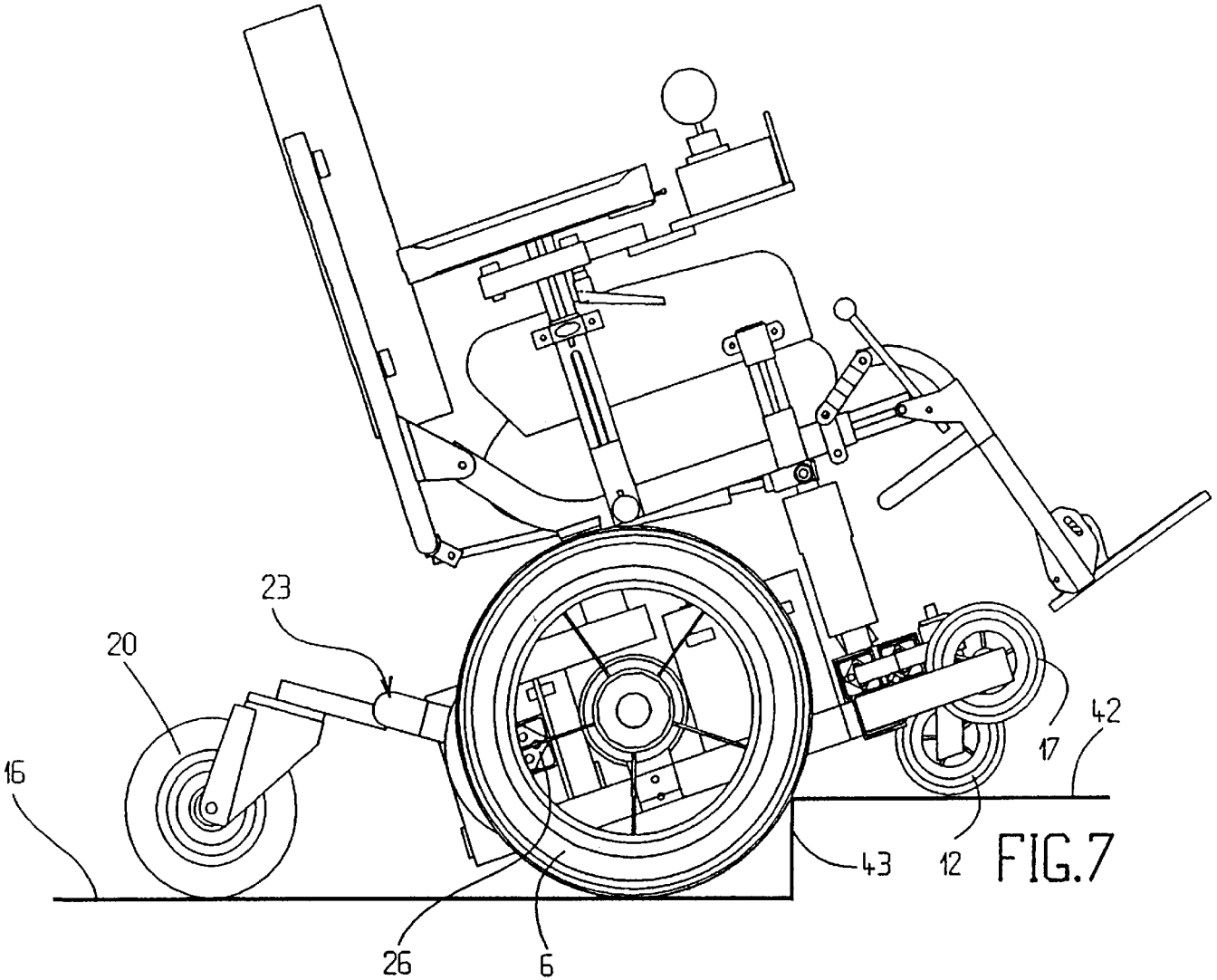
Figure 8:
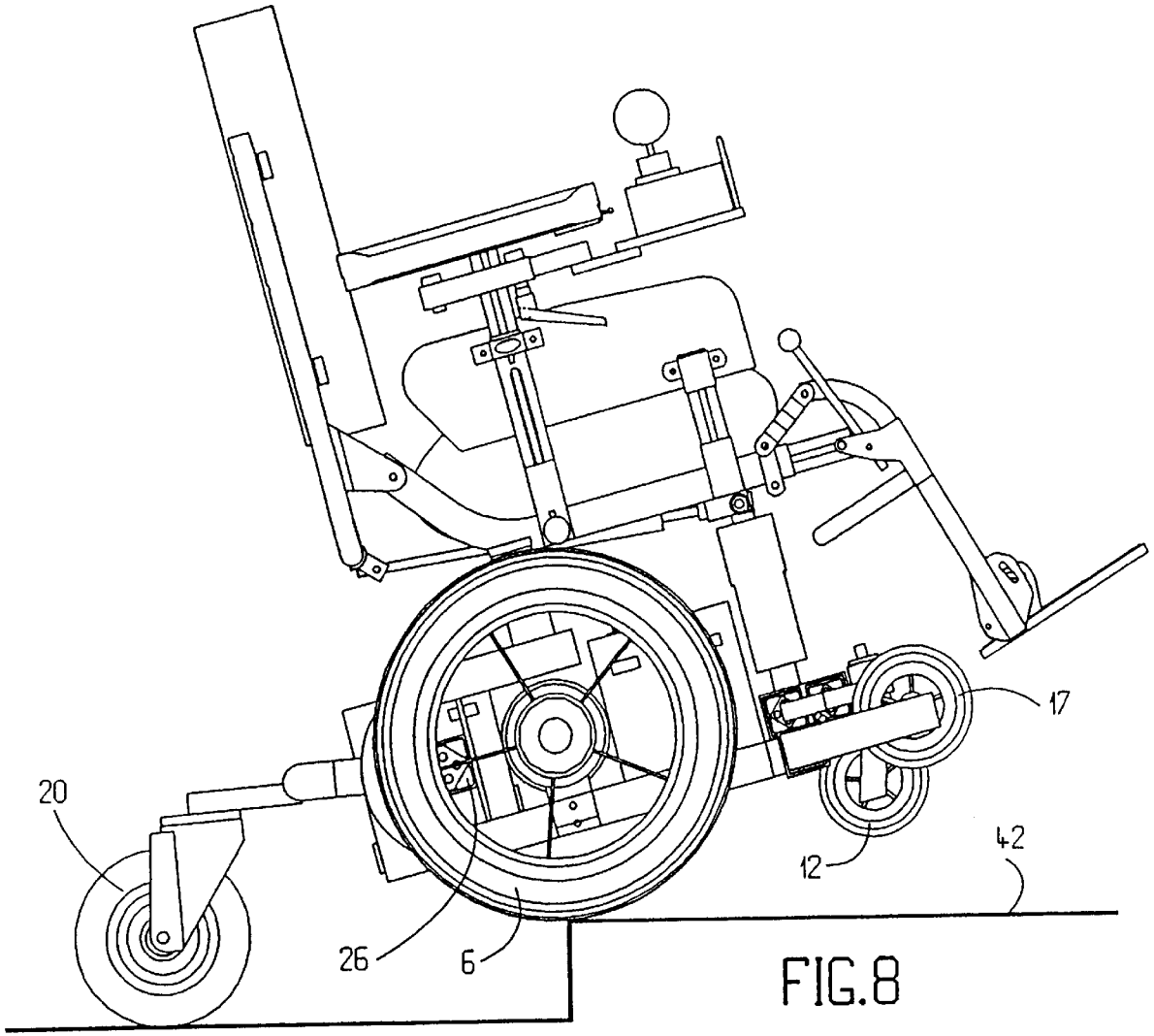

In the position of FIG. 7, main wheels 6 have reached the the sidewalk curb 43 and are relieved of a portion of their usual load, as they are being supported by rear wheel 20. Thus, wheels 6 can reach sidewalk 42 more easily, using the energy stored in spring bearings 26, attaining the position shown in FIG. 8. At this stage, since front wheel 12 is raised, the vertical push of rear wheel 20 tends to tip the wheelchair forward so it resumes its usual position on the sidewalk. The user can assist this repositioning by slightly slowing motorized wheels 6. Experiments have shown that such a wheelchair can access a sidewalk of normal height practically without slowing down.

If the sidewalk is especially high, the user can force the wheelchair to tip back before reaching the sidewalk, using cylinder 39 to move the common center of gravity G behind main axle 7 and thereby lifting front wheel 12, as well as lift wheels 17. This same maneuver is also useful to tip the wheelchair back onto wheel 20 before descending from a sidewalk or before attempting a steep descent. The user gains confidence because he or she has a stable seat and does not risk being ejected forward. Contacting rear wheel 20 allows the user to descend from an obstacle by first using main wheels 6, which provide more comfortable movement because of their large diameter, and which are controlled directly using lever 9. In all these situations, the fact that the center of gravity G is located almost on the vertical of axle 7 of main wheels 6 gives the wheelchair increased stability, even during transverse movement, despite the fact that the user cannot turn front wheel 12 and rear wheel 20 directly.

The design described herein can undergo various modifications and variations without departing from the scope of the invention. It is possible to provide two front contact wheels in place of the one contact wheel 12, and/or two rear contact wheels in place of the one wheel 20. However, using only one wheel, particularly in the back, is less cumbersome, for example, in elevators. Since central rear wheel 20 can be angled into a corner of the elevator car, the user has access to smaller elevators than with ordinary wheelchairs. An advantageous embodiment, not shown in the drawings, provides a telescoping arm 23 to support rear wheel 20, with a control mechanism for the user to select the length of the arm during operation. Thus, not only can the bulk of the wheelchair be reduced, but also the torque of rear wheel 20 provided by spring bearings 26. By lengthening support arm 23, the user can tip the wheelchair back more forcibly, particularly to climb a tall obstacle or descend a steep slope. Moreover, since backward movement is controlled, lift wheels 17 could be eliminated. Yet another variation consists of replacing rear turning wheel 20 with a ball shaped wheel that can roll in any direction.

A further advantageous embodiment of such a motorized wheelchair consists of storing energy in advance, that is, before negotiating an obstacle, and releasing it when the chair is raised to overcome the obstacle. This can be done by first constraining spring bearings 19, 26 on support arms 18 and/or rear support arm 23, using electrical motors or hydraulic shafts. Such a device can raise lift wheels 17 to access an especially high sidewalk and then free them on command or automatically when they contact the sidewalk, in order to help raise the wheelchair to the level shown in FIGS. 6 and 7.

In certain types of motorized wheelchairs, there is an automatic seat level adjustment means, which might be used to position a user at a work station. If this mechanism is controlled by inclined grooves, it also displaces the center of gravity G toward the back or toward the front, to either complement or replace the tipping action around axle 36.

FIGS. 9 through 11 shown an embodiment of the manually controlled wheelchair according to the invention. The construction of this folding wheelchair is known in the art and will not be described in detail here. However, it should be noted that main wheelchair chassis 44 comprises two rigid lateral portions 44*a* and 44*b* which are symmetrical and joined by cross-shaped arms 45 which can be disconnected at one end, allowing the two lateral portions 44*a* and 44*b* to come together so the chair can be folded. Each lateral portion has a main wheel 46 with a manual drive ring 47, a turning front contact wheel 48 analogous to front wheel 12 of the preceding example, and a rear contact wheel 49 of adjustable height, in accordance with the invention, to provide dynamic contact when the wheelchair inclines back. Since the axle of the two main wheels 46 is almost on the vertical of the center of gravity common to the chair and the user, the user can take full advantage of this dynamic effect. The two contact wheels 49 play essentially the same role as wheel 20 in the preceding example. In this example, they do not turn, but they could turn. Because of their rounded transverse shape and relative firmness, they can slide laterally along the ground if necessary, particularly if the user forces the wheelchair to turn by imposing different speeds on main wheels 46.

Each rear contact wheel 49 is flexibly mounted on corresponding lateral portion 44*a*, 44*b* of the main chassis by means of an angled inclinable arm 50, the lower portion of which holds wheel 49 and the upper portion of which, being approximately vertical, is supported by spring bearing 51 which is a "ROSTA" type bearing, thereby allowing it to tip elastically around a horizontal axle 52 (FIG. 11). Thus, arm 50 constitutes a second portion of the wheelchair chassis unit, articulated by bearing 51 to the first portion, consisting of main chassis 44. Bearing 51 is blocked in an adjustable position by means of a threaded flange 53 on a tubular support 54, which is attached to the rear support of chassis 44 by means of a clamp 55 affixed with screws 56. This attachment allows each arm 50 to be positioned anywhere when at rest, particularly to maintain rear contact wheels 49 slightly above the ground when the wheelchair is resting on front wheels 48.

Climbing over an obstacle such as a sidewalk curb is done in the same way as in the preceding example, except there is no additional front lift wheel. However, such wheels could be provided. The diamond-shaped arrangement of wheels 6, 12 and 20 of the first example could also be adapted for a manually operated wheelchair, either collapsible or not.

FIGS. 12 through 15 illustrate various possible dispositions, among others, of the main elements of an articulated chassis according to the invention. To simplify the explanation, the same reference numerals are used to designate functional elements with analogous roles in the different examples, even though construction varies. In each case shown the direction of the front of the seat corresponds to arrow A or arrow B, as a function of the application, the type of propulsion used, and the dynamic effect. Generally speaking, each of the devices shown comprises an articulated chassis 60 comprising a first portion 61 and a second portion 62 connected by an articulation 63 with a horizontal transverse axle. There is a support means 64 on chassis 60, which supports the user and is usually a seat. The first portion 61 of the chassis has two main wheels 66 turning around a main common axle 67, and one or more contact wheels 68 near one end of the seat. Near the other end of the seat, the second portion 62 of the chassis is equipped with one or more contact wheels 69. Preferably, each contact wheel 68, 69 turns freely by pivoting around axle 70, 71, which is vertical or slightly inclined from the vertical. Both main wheels 66 support the largest portion of weight P which the user applies to the seat, given that the vertical line of action p of this weight passes near main axle 67 of wheels 66. The same is true for vertical line g (FIGS. 13 and 14) passing through center of gravity G common to the user and the seat. However, in each case, the specific configuration of articulated chassis 60 may distribute a small part of the weight on contact wheels 68 and/or 69, except in certain applications shown in FIG. 14, where wheel 69 can be raised.

In FIG. 12, the support or seat 64 is attached to the second portion 62 of the chassis, so that weight P and the dead weight of this portion of the seat are distributed between articulation 63 (the majority) and the contact wheel or wheels 69. The weight thus applied at 63 to the first portion 61 of the chassis is distributed between the main wheels 66 (the majority) and the contact wheel or wheels 68. The portion of total weight supported by main wheels 66 depends above all on the horizontal distance between main axle 67 and articulation 63. For example, this portion may range from 50% to almost 100%, depending upon the distance selected. The portion of the weight acting on the contact wheel or wheels 69 depends above all on the distance between articulation 63 and vertical line of action p. Note that it does not depend upon the position of the main axle in relation to this line of action p, and the main axle can actually be situated on either side of this line without affecting chassis stability.

The configuration of the chair shown in FIG. 12 offers specific advantages. In general, all the wheels remain permanently on the ground, maintained by static forces which vary very little when the ground is uneven, at least if there is only one contact wheel 68, 69 at each extremity (in the diamond-shaped disposition). Articulation 63 can pivot freely, and the relative pivoting amplitude between the two chassis portions 61 and 62 can be limited simply with stops (not shown) if there is space. If desired, it is possible to fold the two chassis portions over each other to reduce size when not in use. Support 64 can be attached to second chassis portion 62 in any suitable manner, and its length and height adjusted, perhaps by using the device provided for the user to tip the chair. Furthermore, an energy storage means such as a spring 72 can easily be added, connecting the two chassis portions 61 and 62 (by means of a support 64 in the example in the drawing) to modify the static and dynamic behavior of the chair. It is also possible to obtain the dynamic effects described above with reference to FIGS. 5 through 8 to clear obstacles. With or without such a spring, the user is far more comfortable than in a rigid chassis wheelchair, since when any one of wheels 66, 68, 69 moves vertically to negotiate an obstacle, the vertical movement of support 64 is considerably smaller. Suspension means can either be eliminated, or low-clearance suspension means used, providing greater stopping stability than flexible suspension systems.

Figure 13:
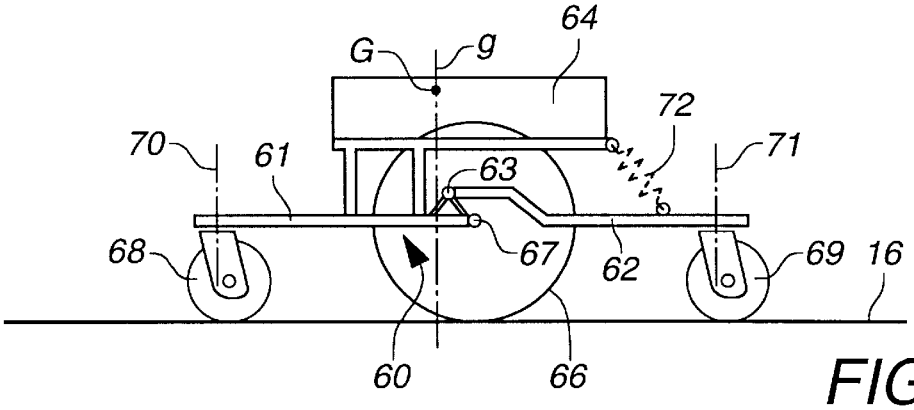

In the case of FIG. 13, the configuration of chassis 60 resembles that of FIG. 12, but support means 64 is rigidly attached to the first chassis portion 61. The second portion 62 and its support wheel or wheels 69 are charged by means of spring element 72 which stores mechanical energy when climbing over obstacles. The position of articulation 63 in relation to main axle 67 is not particularly important to static weight distribution, except if chassis portion 62 is supporting considerable dead weight, such as electrical drive batteries. The load on contact wheel or wheels 68 depends essentially upon the horizontal distance between main axle 67 and the vertical g.

The configuration shown in FIG. 14 differs from that of FIG. 13 only in the fact that chassis articulation 63 is on the other side of main axle 67, that is, between the axle and the contact wheel or wheels 69. This corresponds to the examples described earlier with reference to FIGS. 1 through 11, with spring 72 providing a schematic representation of the effects of the flexible elements of spring bearings 26, which are shown by articulation 63.

Figure 15:
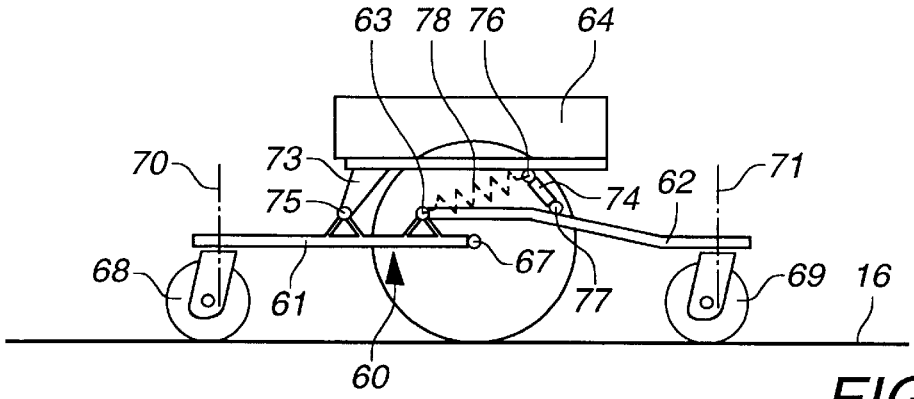

In the case of FIG. 15, chassis 60 and wheels 66, 68 and 69 are disposed as in FIG. 12, but support means 64 is attached to both the first portion 61 and the second portion 62 of the chassis, using two rigid elements 73 and 74, and articulations 75 through 77. Elements 61, 62, 73 and 74 define a deformable quadrilateral in the vertical plane, which offers the advantage of reducing the movements of support means 64 when one wheel clears an obstacle. There may be a spring or shock 78 in this quadrilateral, for example, in the form of spring bearings 26 described above and incorporated in articulation 63, to improve the dynamics and, if required, to store energy.

FIG. 16 illustrates a motorized wheelchair for a handicapped person, with articulated chassis 60 having the same kinematic arrangement as in FIG. 12. The first chassis portion 61 is equipped with two main wheels 66 and a sole rear contact wheel 68 which turns freely by pivoting around a vertical axle 70 located in the vertical median plane of the wheelchair. The second chassis portion 62 is equipped with a sole front contact wheel 69, which also turns freely by pivoting around a vertical axle 71 located in the vertical median plane of the wheelchair. Thus, the wheels are disposed analogously to the examples in FIGS. 1 through 8, comprising an improved embodiment of that design which incorporates all the previous elements except rear arm 23, replaced by chassis portion 61. In particular, the wheelchair may be provided with front lift wheels 17 described in the first example and not shown in FIG. 16.

In accordance with the basic characteristic of the invention, main axle 67 of drive wheels 66 is located near the vertical line passing through the center of gravity common to the wheelchair and the user. Chassis articulation 63 is located behind this axle, at a fixed or adjustable distance, which affects the static load supported by rear wheel 68. Preferably, this load comprises from 1% to about 15% of the total weight of the wheelchair and the user. The static load on front wheel 69 depends primarily on the distance between articulation 63 and the vertical passing through the center of gravity. It is generally greater than that of rear wheel 68, in order to counteract the tendency of second chassis portion 62 to tip back during steep ascents, and it preferably ranges from about 8% to about 25% of the total weight. To increase stability and inertia in the front wheelchair portion, and for reasons of comfort, second chassis portion 62 supports not only seat 2 and the user, but also the heavy storage batteries 80, placed as low as possible and near main axle 67. The two electric motors 81, similar to motor 8 described above, are supported by first chassis portion 61. As in the first example described, seat 2 is inclinable, as it moves on horizontal axle 36, regulated by a shaft 39 controlled by the user. Another option is for a spring and/or shock element 82 to connect the rear of the seat with first chassis portion 61 to improve the dynamics of the wheelchair and especially, to prevent second chassis portion 62 from suddenly tipping backwards, for example, during a steep ascent. Element 82 may have non-linear flexibility, exerting relatively strong force when the tipping action begins, safeguarding the user, then only slightly increasing force to avoid shifting the balance between the motorized main wheels. It is also possible to replace element 82 with a shaft controlled automatically by receptors detecting slopes and obstacles as they are encountered, for example, on the basis of the load supported by the front and rear wheels.

FIG. 16 demonstrates that it is possible to design an embodiment in which the first chassis portion 61 can be removed by disassembling articulation 63, to be replaced temporarily by a pair of non-motorized main wheels, or by another first chassis portion that is manually controlled, comprising two main wheels and one or more rear contact wheels 68. In this case, all the motorized drive elements, including batteries 80, would preferably be mounted on the first removable chassis portion 61. This concept offers a versatile piece of equipment, which can be transformed at will into either a stroller for an invalid or a handicapped person, or a motorized wheelchair. While the user operates the wheelchair manually, for example, indoors, the control unit can be connected to an electrical supply and recharged.

FIGS. 17 and 18 show a stroller for a child, with a chassis corresponding to FIG. 14 and to the wheelchair shown in FIGS. 1 through 8. The first portion of the chassis is a main rigid chassis 61 which is cross-shaped, comprising, as shown in FIG. 18, a rigid crossbar 84 supported by two main wheels 66 located beneath the seat 85, and a central longitudinal bar 86, the front extremity of which is supported by front wheel 68, which turns freely. The rear extremity of bar 86 is equipped with a spring bearing 87 analogous to bearings 26 in the first example described, forming a flexible articulation with a horizontal axle 88. On this articulation there is mounted an inclinable rear arm 89, performing the same function as arm 23 described above and contacting rear wheel 69, which turns freely. Main chassis 61 further comprises a central support 90 to which seat 85 is attached, preferably using an articulation 91 and a notched mechanism (not shown) so the seat can be inclined in different positions. A stroller handle 92 of the usual type, for example, curved in shape with two lateral rods 93, is rigidly attached to central support 90. As in the preceding examples, because the large main wheels 66 are disposed beneath the seat, comfort and stability are improved, particularly because there is little weight on front wheel 68, which is the first to encounter obstacles. The approximate diamond-shape of the wheel arrangement reduces the size of the stroller and improves turning. During propulsion, a horizontal push applied to handle 92 does not affect the stability of the stroller on wheels 66 and 68. On the other hand, it is very easy to clear an obstacle by pressing handle 92 down to raise front wheel 68, thereby increasing the load on rear wheel 69. The energy thus accumulated by spring bearing 87 assists main wheels 66 as they climb the obstacle, in combination with the horizontal push on handle 92. Thus, the stroller has the same advantages as the wheelchair of FIGS. 1 through 8, insofar as it can clear obstacles and perform on rough terrain. Additionally, the fact that pressing on handle 92 causes play in the chassis articulation allows it to easily descend steep slopes and even stairs. It is also possible to regulate the level of rear wheel 69 using a pedal-activated, notched device, for example, at the location of articulation 87, to facilitate descending stairs and/or pull up the rear wheel.

The stroller embodiment shown in FIGS. 17 and 18 is merely one example, and many modifications and variations are possible. More specifically, it could have two front castors 68, and/or two rear castors 69. The seat 85 could be removable and replaced by a baby carriage. Main wheels 66, which support the majority of the weight, could advantageously be equipped with brakes. All sorts of accessories known in the field could also be added, such as a basket for holding packages or an additional support for a second child, a seat-raising mechanism to aid in lifting the child or helping the child to stand, etc. A stroller of the same type could also be useful for transporting a handicapped person.

FIGS. 19 and 20 show a novel wheelchair, specially designed to be propelled by a person who has lost the use of one leg due to an accident, illness or other handicap, by pushing it with one leg. This device allows the user to move himself or herself and park, particularly at home or in a medical facility, while keeping the hands free for other tasks such as personal care, dressing, carrying objects, and performing household or office tasks.

The chassis corresponds to that of FIG. 14, with the direction of the front end shown by arrow B because the user is turned in that direction. First chassis portion 61 has two main wheels 66, on the main common axle 67, and two turning front castors 68 disposed laterally, approximately in front of main wheels 66, with a free space 101 formed between them for the user's legs. Chassis portion 61 is made of metal tubes soldered together, comprising a pair of angled metal tubes 102 contacting front castors 68 and supporting seat 103, an upper crossbar 104 connecting both tubes 102 beneath seat 103, a rear bar 105 with its extremities 106 attached to tubes 102, and two lateral supports 107 holding main wheels 66 and brakes 108 associated therewith. The second chassis portion 62 consists of an inclinable rear arm 109, analogous to arm 89 described with reference to FIG. 17, and which contacts a sole rear central castor 69 that turns freely. The two chassis portions 61 and 62 are connected by a flexible articulation comprising a spring bearing 110 analogous to spring bearing 87 described above and which functions in the same way.

Seat 103 may or may not have a back support; it is telescopically connected to tubes 102 for adjusting the height. Its shape, shown by dashed lines in FIG. 20 to clarify the drawing, is designed so the user can propel the wheelchair by pushing one foot along the ground. For this reason, the front of seat 103 has a central indentation 112 between two lateral portions 113 that project toward the front to provide a prop for the leg not used during propulsion, or for both legs when the wheelchair is stopped. Indented seat portion 112 is above the free space 101 formed in the center of the chassis and also extending below the seat, between main wheels 66. Thus, the user can easily propel himself or herself either forward or backward, and perform turns, by leaning one foot on the ground. Contact castors 68 and 69 offer the advantages described in the preceding examples insofar as they provide stability, easy manipulation, and the ability to clear obstacles. When stopping, the user can apply brakes 108 using one or more control levers 114 mounted underneath seat 103 and connected to the brakes by covered cables 115.

FIGS. 21 and 22 show a device for assisting walking, sometimes called a "walker." In known manner, the device comprises a main chassis 121 with two main wheels 66, at least one front castor 68 that turns freely, and two lateral handles 122 on which the user can rest his or her hands or forearms while walking and pushing the device forward. The main chassis 121 folds for storage and carrying, as rear wheel 68 is attached to a folding element 123 attached to articulation 124 and folding arms 125. Main wheels 66 are equipped with brakes 126 which the user activates with a control handle 127 and cables 128.

In accordance with the invention, main wheels 66 are disposed so their axle 67 is located practically at the vertical of handles 122, that is, near the line of action of the contact force which the user exerts on the handles. These relatively large wheels, therefore, generally support the quasi-totality of the load, and well enough so that the chair rolls easily. According to another characteristic of the invention, the chassis of the device is completed, as in FIG. 14, by two rear arms 130 which are each connected to the main chassis 121 by a spring bearing 131, and which contact a rear castor 69 that turns freely. Bearings 131, aligned coaxially, constitute the flexible articulations on the chassis and allow the user to tip the main chassis 121 backward to raise front castor 68, for example, to clear a threshold, and thus benefit from the accumulated energy to reposition the apparatus upright, as in the preceding examples. Furthermore, the device manipulates easily and can pivot in place around the user, since it is located in the central zone 133 between the two non-turning main wheels 66. It is also possible to replace each rear castor 69 with a shoe with which the user can apply braking action without resorting to brakes 126, 127.

FIGS. 23 and 24 show an accessory designed to slightly raise main wheels 6 or 66 on a wheelchair such as those in FIGS. 1–8 and 16, to allow the tires to be cleaned while the motors turn them; during this procedure, the front and rear contact wheels stabilize the wheelchair longitudinally. This accessory is formed of a rigid cradle 140, which may be made of a metal tube forming two parallel arms 141 connected by a handle element 142. Extremities 143 of arms 141 are angled upward and provided with concave supports 144 to place under the hubs of the main wheels. Castors 145 are mounted near the arm elbows, and there are blocks 146 underneath element 142 to support the carriage on the ground 147 in the position shown. By holding element 142 in the raised position, an assistant can roll the device, place supports 144 under the hubs of the main wheels at the rear of the device, and can then easily raise these wheels by lowering that element to the ground. Then a rag or a brush can be used to clean each wheel as it turns. The articulated chassis design according to the invention also makes it possible to have a double-footed lever near the main wheels, which is actuated by an electric shaft, and is used to raise the central chassis zone for the same purpose.

FIGS. 25 and 26 show another feature of the invention, in the form of a wheelchair with a chassis 150 consisting of two rigid portions 151 and 152 which, rather than being connected by an articulation as in the preceding examples, have a vertically oriented sliding connection 153. The first chassis portion 151 has a seat 154 and two main wheels 156 with electric motors 155, and the main axle 157 of wheels 156 is approximately at the vertical of the center of gravity of the chair and its occupant, as in the wheelchairs described above. The second portion 152 has a front contact wheel 158 and a rear contact wheel 159, both of which turn and are preferably located in the median plane of the wheelchair. Said portion 152 comprises, in the central zone, vertical guides 160 (shown schematically) which slide along a central vertical shaft 161 on the first portion, said shaft containing a spring 162 which pushes the second portion down to exert a permanent, but variable, force on contact wheels 158 and 159. Obviously, there could be two or more front contact wheels 158 and/or rear contact wheels 159.

When one of the contact wheels, such as wheel 158 in FIG. 26, clears an obstacle 163, the second portion 152 raises above first portion 151 and thus compresses spring 162, relieving some of the pressure on main wheels 156. At the same time, the chair tips back slightly, which may be facilitated by accelerating motors 155 slightly, as described in the first example. However, this type of chassis tips back only half as far as the chassis in FIG. 7. Lift wheels such as wheels 17 (FIGS. 1–8) can also be provided in front of front wheel 158. Moreover, this type of chassis can be used with any of the applications described above.

FIG. 27 is a schematic representation of the example of FIGS. 25 and 26, with sliding connection 153, to which a flexible articulation with a transverse axle has been added, parallel to main axle 157, in the form of a spring bearing 164 analogous to bearings 26, 87, 110, 131 described above. This bearing slides vertically in hollow central shaft 161, where spring 162 exerts pressure on it. The flexible articulation causes seat 154 and first chassis portion 151 to oscillate slightly toward the front and the rear in relation to second portion 152, and reciprocally, thereby absorbing some of the horizontal shocks caused by obstacles or a rough surface.

With reference to FIGS. 28 and 29, the chair shown is a type of motorized tricycle or "scooter" for handicapped individuals. It consists primarily of a chassis 170 with a seat 171, two main motorized wheels 172 and a front wheel 173 attached to an articulated fork 174 extending into a handlebar 175 that controls direction. Batteries 176 are located on the chassis on either side of a telescoping support 177 which also holds seat 171.

A castor 177 is located at the rear of the vehicle, held by two arms 178 attached to the chassis by springs 179 designed to accumulate a certain amount of energy which is released in the form of a contact force to facilitate clearing obstacles, as described above.

The present invention is not limited to the exemplary embodiments and applications described herein. In particular, each application could have a chassis configuration based on any of the designs shown in FIGS. 12 through 15 or the variations thereof. In every variation, the seat and the chassis can also be folded up and/or disassembled.

We claim:

1. A wheelchair for transporting or assisting the displacement of at least one user, particularly a handicapped person or a child, comprising a chassis equipped with wheels and with a support means for supporting at least a portion of the user's weight when the wheel chair is moving on a ground, said chassis comprising:

a first chassis portion supported by the ground and equipped with two main wheels rotatable around a common transverse main axis and with at least one front caster wheel located in front of said main axis;

a second chassis portion designed to be supported by both the first chassis portion and the ground and being equipped with at least one rear caster wheel located behind said main axis, each rear caster wheel being mounted to an arm forming said second chassis portion, said arm being connected to said first chassis portion by a main articulation having an axis parallel to said main axis;

energy accumulator means connected to said first and second chassis portion for storing mechanical energy when said at least one rear caster wheel is raised above a plane of a supporting surface defined by said main and caster wheels of said first chassis portion, said energy accumulator means comprising at least one spring capable of exerting a variable force on said arm as a function of the position of said arm with respect to said first chassis portion, said spring being located in a housing containing a bearing of said main articulation.

2. A chair according to claim 1, characterized in that the support means (2, 64, 85, 103, 122) are attached to the first chassis portion (1, 61), and in that said spring (72) exerts a permanent contact force on the second chassis portion (23, 62, 130).

3. A wheelchair according to claim 2, wherein the support means comprises a seat for said user, the seat (2) being moveable toward the front and the back in relation to the chassis using a manipulating device (39) controlled by the user.

4. A chair according to claim 3, characterized in that the said seat (2) can tip on an axle (36) located beneath the seat.

5. A chair according to claim 1, characterized in that it comprises only one front caster wheel.

6. A chair according to claim 1, characterized in that it comprises only one rear caster wheel.

7. A chair according to claim 1, characterized in that the front and rear caster wheels (12, 20, 68, 69) are attached in a generally longitudinal median plane of the chair.

8. A chair according to claim 1, characterized by having at least one lifting device (17) at the front, located in front of and higher than the front caster wheel or wheels (12), which contacts an obstacle and causes the main articulation to pivot, thereby imparting energy to said energy accumulator (26).

9. A chair according to claim 8, characterized in that each lifting device comprises at least one lift wheel (17) attached to one front extremity of a support arm (18) which is flexibly attached to the chassis (60, 100) so as to permit said lift wheel to move vertically when it encounters an obstacle.

10. A chair according to claim 1, characterized in that the main wheels (6, 46, 66) are the drive wheels, and can be driven in reverse and/or at different respective speeds to turn the chair.

11. A chair according to claim 10, with a folding chassis comprising two rigid lateral portions (44*a*, 44*b*), each provided with a main wheel (46), and characterized by having at least one rear contact wheel (49) attached to one of said lateral portions.

12. A chair according to claim 1, characterized in that the support means comprises a seat (2, 85, 103, 171) for the user.

13. A chair according to claim 1, wherein said support means includes a seat for said user, said seat being substantially in vertical alignment with said transverse main axis.

* * * * *